US008267667B2

(12) United States Patent
Freudenberger et al.

(10) Patent No.: US 8,267,667 B2
(45) Date of Patent: Sep. 18, 2012

(54) MAGNETIC DRIVE METERING PUMP

(75) Inventors: Thomas Freudenberger, Ludwigshafen (DE); Andreas Hoehler, Heppenheim (DE)

(73) Assignee: Prominent Dosiertechnik GmbH, Heidelberg (DE)

( * ) Notice: Subject to any disclaimer, the term of this patent is extended or adjusted under 35 U.S.C. 154(b) by 1015 days.

(21) Appl. No.: 11/507,167

(22) Filed: Aug. 21, 2006

(65) Prior Publication Data

US 2007/0040454 A1 Feb. 22, 2007

(30) Foreign Application Priority Data

Aug. 22, 2005 (DE) ..... 10 2005 039 772

(51) Int. Cl.
*F04B 39/06* (2006.01)
*F04B 17/03* (2006.01)

(52) U.S. Cl. ..... 417/44.1; 417/413.1

(58) Field of Classification Search ..... 92/96; 417/44.1, 417/63, 212, 413.1, 416; 73/861.78
See application file for complete search history.

(56) References Cited

U.S. PATENT DOCUMENTS

| | | | | |
|---|---|---|---|---|
| 4,345,483 | A * | 8/1982 | Paletta et al. | 73/864.16 |
| 4,832,582 | A * | 5/1989 | Buffet | 417/413.1 |
| 5,816,778 | A * | 10/1998 | Elsey et al. | 417/46 |
| 6,125,145 | A * | 9/2000 | Koyanagi et al. | 375/240.16 |
| 6,135,724 | A | 10/2000 | Yoder et al. | 417/286 |
| 2008/0226466 | A1 * | 9/2008 | Eysymontt | 417/53 |

FOREIGN PATENT DOCUMENTS

| | | |
|---|---|---|
| DE | 1628175 | 7/1971 |
| DE | 19532037 | 12/1996 |
| DE | 10162773 | 7/2003 |
| EP | 0798558 | * 10/1997 |
| EP | 1344933 | 9/2003 |
| GB | 2352890 | 2/2001 |
| WO | WO 00/22298 | 4/2000 |
| WO | WO 2005/054676 | 6/2005 |

* cited by examiner

*Primary Examiner* — Devon Kramer
*Assistant Examiner* — Bryan Lettman
(74) *Attorney, Agent, or Firm* — Michael L. Dunn

(57) ABSTRACT

A magnetic drive metering pump in which a movable thrust member is fixed to a diaphragm and is axially movable in a magnet shroud. The thrust member, on electrically actuating the magnet shroud, is drawn into the magnet shroud against the force of a recuperating spring, and after deactivating the magnet shroud, is returned to a starting position. The diaphragm cooperates alternately with an outlet and an inlet valve to produce a pump stroke in a pump metering head. The magnetic drive metering pump has a reference element associated with the thrust member and diaphragm, the position of which reference element is detected by a positional sensor. The positional sensor provides a signal which has a fixed relationship to the position of the reference element, and the motion of the thrust member is controlled by a control circuit such that it follows a predetermined nominal profile.

13 Claims, 11 Drawing Sheets

MAGNETIC DRIVE METERING PUMP

BACKGROUND OF THE INVENTION

The invention relates to a magnetic drive metering pump in which a movable thrust member fixed to a connecting rod is axially movable in a longitudinal axis in a magnet shroud anchored in a pump housing. A compression spring or recuperating spring, with uncontrolled magnets, keeps the thrust member from an inner face of the magnet shroud so that an airgap is formed between the two faces. The thrust member with the connecting rod, on electrically driving (actuating) the magnetizing coil, is drawn into the magnet shroud against the force of a recuperating spring, reducing the airgap, into a bore in the magnet shroud and after deactivating the magnet the thrust member is returned to the starting position by the recuperating spring so that the thrust member and an elastic displacement member actuated thereby carries out an oscillating motion on continued activation and deactivation of the magnetizing coil, which diaphragm cooperates alternately with an outlet and an inlet valve to produce a pump stroke (pressure stroke) and a priming stroke in a metering head arranged in the longitudinal axis, Magnetic drive metering pumps similar to the above are generally known and are matched to requirements by add-ons. They operate volumetrically, wherein metering is carried out by transporting a closed volume. The metered volume per stroke thus corresponds to the difference in volume on movement of the diaphragm.

In such magnetic drive metering pumps, as previously discussed, a movable thrust member is mounted in a stationary magnet shroud so that when the magnetic coil is driven, it is drawn into the magnet shroud, the airgap shrinks and after switching off the electric drive, the thrust member is impelled back into its starting position by a recuperating spring. A connecting rod is fixedly associated with the thrust member and transfers the motion and force to the metering diaphragm.

In the simplest case, the stroke magnet is switched on for a particular period to execute a metering stroke. Other embodiments supply the magnetizing coil with a controlled current in accordance with a predetermined time profile, wherein the magnetic force and thus the metering performance is more reproducible and independent of electrical parameters such as the actual power of the mains.

The stroke frequency is given by the repetition frequency of the electrical drive pulse. The stroke length can, for example, be altered by means of a mechanically adjustable spindle which sets the start point of the stroke motion; the end point is given when the magnet has moved in completely. In one possible embodiment, a stroke adjustment pin is screwed into a thread in the pump housing and has a calibrated knob accessible from the outside, the back of which is fixed to the magnet shroud or its position is fixed with respect to the magnet shroud.

The motion of the diaphragm occurs by a combination of the effective forces. After switching on, the magnetic current and therefore the force produced initially rises, slowed by self-induction; when the force on the connecting rod generated by the diaphragm and the recuperating spring is overcome, the thrust member begins to move. The airgap shrinks and the corresponding magnetic force rises further. The thrust member accelerates quickly and impinges against the shroud, curbed only by an O-ring which is generally present. The entire movement is executed in a few milliseconds, resulting in very high instantaneous speeds for the metering medium and high pressure peaks, up to twice the operating pressure and beyond.

The diaphragm is not rigid, but deforms elastically by a particular amount in the flexing region when the pressure of the metering medium operates thereon. The amount of the deformation is lost to the effective stroke motion and the result is that with increasing operational pressure, the metered amount reduces. This drop-off characteristic is much more prominent in normal use than allowed by the metering accuracy. Thus, magnetic drive metering pumps normally cannot be used over a wide range of operating pressures with the desired accuracy; moreover, the errors which arise by calibration are exacerbated as they are included in further calculations. However, said calibration measurement must be carried out in use under actual operating conditions and particularly when using aggressive chemicals, is a step which is extremely difficult.

Current magnetic drives have just a few simple parts and thus are easy to manufacture, but are relatively limited in application and suffer from disadvantages as regards the hydraulic properties of the metering process compared with a motor-driven pump. The motor drive, which is transferred, for example by means of a gear or cam, has more applications and for many processes it has better metering properties, but is much more expensive to produce.

BRIEF DESCRIPTION OF THE INVENTION

Figure 1:
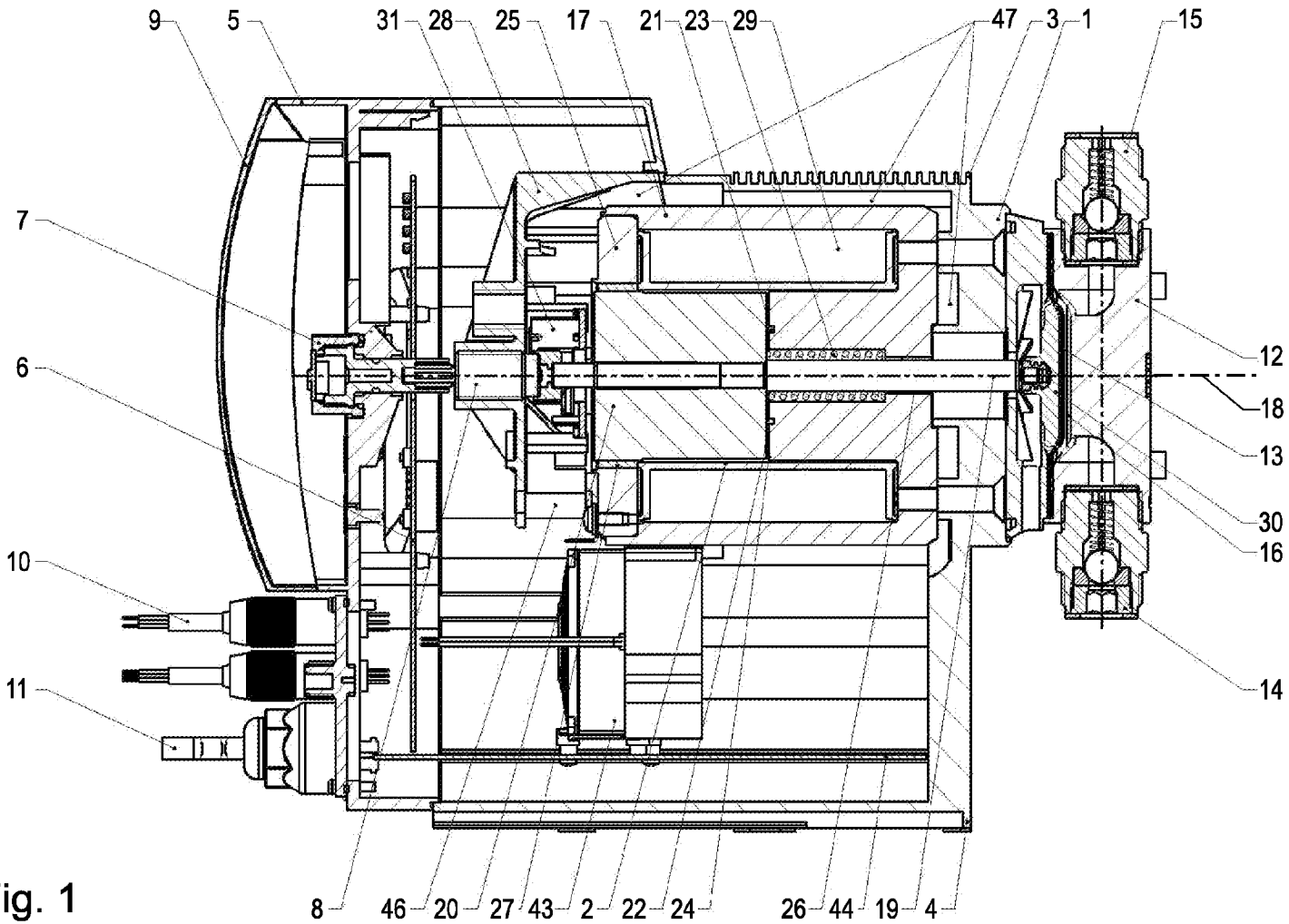
FIG. 1 shows a cross section through a magnetic drive metering pump with controlled magnet.
Figure 2:
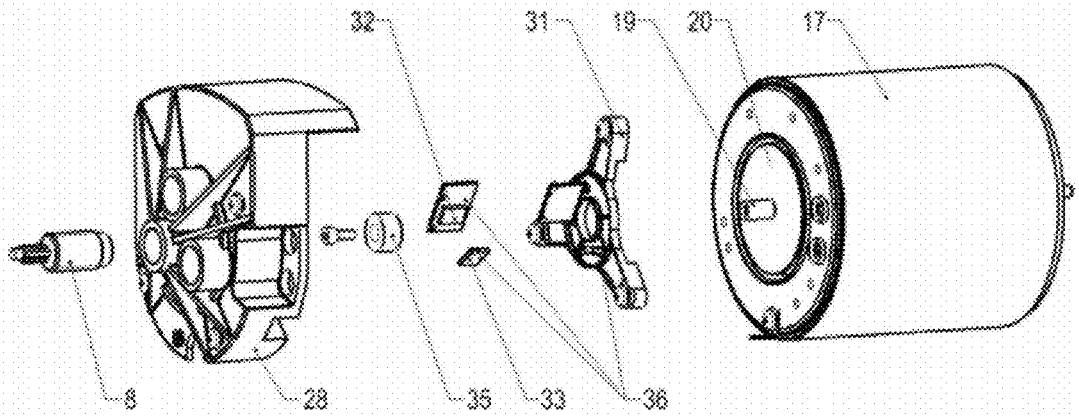
FIG. 2 shows an exploded view of the positional sensor (enlargement of section X in FIG. 1)

In accordance with the invention, a magnetic drive metering pump is provided in which a movable thrust member fixed to a connecting rod, in turn connected to a flexible pumping diaphragm, is axially movable in a longitudinal axis in a magnet shroud anchored in a pump housing so that the thrust member with the connecting rod, on electrically activating a magnetizing coil to magnetize a magnet in the magnetic shroud, is drawn into the magnet shroud against the force of a recuperating spring into a bore in the magnet shroud. As a result, an air gap between the thrust member and an inner face of magnetic shroud is reduced. After deactivating the magnet the thrust member is returned to the starting position by the recuperating spring so that the thrust member and spring actuated thereby carries out an oscillating motion on continued activation and deactivation of the magnetizing coil. This oscillation in turn causes oscillating of the diaphragm. The diaphragm cooperates alternately with an outlet and an inlet valve to produce a pump stroke (pressure stroke) and a priming stroke in a metering head arranged in the longitudinal axis. A reference element (35) is associated with a module constituted by the thrust member (20) and connecting rod (19), the position of which reference element is detected by a positional sensor (36). The positional sensor provides a signal ($X_I$) which is in a fixed relationship to the position of the reference element. Motion of the unit formed by the thrust member and the connecting rod is influenced as regards control accuracy via a control circuit utilizing the positional sensor signal so that it follows a predetermined nominal profile (38).

DETAILED DESCRIPTION OF THE INVENTION

The particular aim of the invention is to overcome the known disadvantages as regards the hydraulic properties of the metering process and to provide a variable, larger operational range for magnetic drive metering pumps without negatively affecting its advantages, namely easy and cheap manufacture. Further, the motion of the thrust member and the associated connecting rod should be matched to the nominal details so that the metering process itself is adjustable, and any defects caused by manufacture or disadvantageous properties of the elastic diaphragm can be taken into account and compensated for by the control system. The positional indicator should be structured so that variations in assembly and/or problems which arise during service regarding the positional measurement can be compensated for by on-board electronics.

The problem is solved by dint of a reference element which is associated with the module constituted by the thrust member and connecting rod, the position of which is detected by a positional sensor. The positional sensor provides an actual signal which is in a fixed relationship to the position of the reference element, and the motion of the unit formed by the thrust member and connecting rod is influenced by a control circuit as regards its control accuracy so that it follows a predetermined nominal profile.

The control system and positional sensor capture the motion of the thrust member with the connecting rod and move it in a predetermined motional profile. In this regard, starting from the nominal conditions, the control system determines the appropriate motion to be set and then controls it using the motional measurements obtained from the positional sensor and influencing the magnetizing coil current so that metering is carried out in the best possible manner and inaccuracies which arise, for example due to the properties of the diaphragm, are eliminated.

If the positional sensor operates in accordance with a touch-free principle, then wear-free operation of the sensor is guaranteed, which because of the large number of strokes during the service life of a metering pump is advantageous and in fact necessary.

If the positional element associated with the connecting rod is located at the end facing the metering head and outside the metering head, then flexibility as regards space for the positional sensor is increased.

If the reference element influencing the light path of a light source and if the positional sensor cooperating therewith, which is fixed in the magnet shroud, operates as a light-sensitive receiver, then wear-free operation is ensured, which is vital because of the large number of strokes executed during the service life of a metering pump, and the moving parts are swept over without touching them. A further advantage of such an arrangement is that such a structure for a positional sensor is in principle insensitive to stray magnetic fields which are unavoidable when operating the sensor near to magnets.

If the reference element is a shadow-producing body or a shadow-providing body and the cooperating positional sensor which is fixed in the magnet shroud is constituted by a series of light-sensitive charge coupled devices, such an arrangement has important optical properties which must be satisfied by the positional sensor. Firstly, the arrangement operates on a wear-free optical functional principle and is insensitive to stray magnetic fields, and secondly, such a sensor has practically no linearity defects.

If the positional sensor is arranged on its own sensor carrier, which is fixed to the magnet shroud, such an arrangement can be pre-assembled as a module and tested, thus facilitating assembly. If the sensor carrier is formed as a non insulating plastic part, then in addition, electrical insulation of the sensor elements from the magnet shroud is simplified.

If the positional element, the shadow-producing body or the shadow providing contour and the positional sensor constitute a lightbox-like arrangement and if the measurements are fed continuously or supplied stepwise to the electronic control system, such an arrangement provides the electronic control system with positional data at a suitable rate.

If the optical receiver of the positional sensor consists of a plurality of linearly arranged receivers (pixels), preferably 128 pixels, such an arrangement can readily determine the position by determining the edge of the shadow between illuminated and non-illuminated cells and thus clearly has a resolution equal to the separation of the cells of the receiver module.

If the light source is a light emitting diode (LED), which is arranged opposite the positional sensor so that its light beam directed at the receiver is not perturbed by the connecting rod, then this has the advantage that the cheap LED has a near point light source which is vital to high optical resolution, and has an almost limitless service life. Arranging it opposite the positional sensor beyond the connecting rod produces a large distance between the light source and the receiver, which makes the projection angle of the relevant light beams relatively independent of the mounting position of the elements.

If the starting value for the positional sensor (36) is produced by interpolating the brightness values for several pixels lying in the shadow transitional region, then the resolution for the starting signal for the positional sensor is finer than when it is determined by the mechanical pitch of the cells of the CCD receiver.

If filtering means are employed when processing the signals from the positional sensor, the resistance to interference of the positional sensor is improved. The sensitivity of the positional sensor as regards variations in assembly and mechanical displacements during operation, for example during heating up or on wear of the bearings, is reduced if zero position errors of the positional sensor are eliminated by means of a reference memory or scaling errors of the positional sensor are eliminated by including one or more reference positions.

If variations in illumination of the positional sensors are evened out by controlling or regulating the light source using the brightness values obtained for the pixels, the sensitivity of the positional sensor to variations in module parameters is reduced.

If brightness variations between individual pixels of the optical receiver are compensated for by incorporating a reference memory for the sensitivity of each pixel, the effects of dirt on the optical receiver are reduced.

If the signal from the positional sensor is further processed in a control device and compared with a nominal value, wherein the control device influences the current to the magnetizing coil to correct the motion, this intentional influencing of the diaphragm motion can be exploited to achieve or improve advantageous hydraulic properties of the metering, for example for slow metering, for pressure compensation and/or metering accuracy for partial strokes.

If the control device alternately influences the position, speed or acceleration of the thrust member via a control device by changing the coil current, the advantages of the appropriate control method can be exploited if they match the demands of a real metering task. Controlling the diaphragm speed enables the actual flow speed of the metering medium to be controlled directly—this, for example, is necessary to avoid cavitation on slow priming. Controlling the diaphragm position, on the other hand, means that near stationary situations can be controlled, where information regarding speed, obtained by differentiation of the path signal, becomes very small and can no longer be properly processed by the control device. Controlling the diaphragm position gets around this problem and is, for example, used advantageously for electronic stroke length limiting or slow metering. Controlling the acceleration of the diaphragm is advantageous because it is easy to regulate, as the acceleration of moving masses is a direct reflection of magnetic power and thus indirectly of the magnet current.

If the control device intentionally reduces the speed of the thrust member in the priming phase and/or in the pressure phase, pressure losses caused by resistance to flow or the creation of cavitation are counteracted. When metering highly viscous media, for example lecithin, large pressure drops occur in narrow places, such as in the valves, when the flow rate is too high. These pressure drops must be overcome in the form of additional power from the drive and can be kept low by controlling the diaphragm speed. In addition, flow noises on reduced flow speeds can be effectively reduced. When metering media which readily evolve gas, such as chlorine bleach, cavitation frequently occurs particularly during priming, when too high a flow speed is used, by dropping below the vapour pressure of the metering medium, resulting in increased mechanical wear. Controlling the diaphragm speed in the priming phase and/or in the pressure phase advantageously avoids this phenomenon.

If the desired stroke length is communicated by the operator to the control device and the motion of the thrust member is electronically limited by the control device to the stroke length to be executed by controlling the magnetizing coil electronically, then the mechanical adjustment elements can largely be dispensed with. If the motion of the thrust member is limited electronically even for maximum stroke lengths, without reaching the mechanical buffer, then the absorbing O-ring can also be dispensed with.

If the value to which the stroke adjustment is set is determined by measurement during metering directly via the positional sensor, an additional sensor for mechanically positioning the accompanying on-board elements can be dispensed with.

If the control device limits the speed of the thrust member at the beginning and/or end of the pressure phase, for example in the first or last third of the stroke, controlling the magnetizing coil so that pressure peaks which could occur due to rapid changes in speed of the metering medium stream or by impinging hard against the mechanical buffer are prevented means that otherwise necessary additional accessories such as pulsation moderators can be dispensed with.

If the control device limits the speed of the thrust member at the end of the pressure phase by controlling the magnetizing coil so that overstraining is avoided, then the metering accuracy is substantially improved, particularly at low back pressures.

If the control device distributes the forward motion of the thrust member during the pressure phase by driving the magnetizing coil for the period given by the repetition rate of the metering stroke, so that the metering medium is dispensed in the smoothest manner possible, even with very slow metering strokes of several minutes duration, for example, then concentration variations in the metering medium can be substantially avoided.

If, when operating in continuous metering mode, i.e. essentially without a pause between priming and the next metering stroke, the control device changes the stroke motion to a stroke motion with a reduced stroke length and an increased stroke frequency and keeps the diaphragm speed in the metering stroke almost the same to provide the desired metering performance, and if it finishes priming by controlling the magnetizing coil before the thrust member is impelled by the recuperating spring completely onto the front mechanical (rest) buffer, so that the motion of the thrust member occurs only in the stroke motion domain, wherein the airgap and thus the magnet current requirement are small, then on a time basis, the required electrical drive and the resulting heat loss are reduced.

The metering accuracy is improved if during the start phase of the controlled forward motion of the thrust member either the control device itself or a further control unit observes the magnet current, deduces the power profile and thus detects opening of the outlet valve from the instantaneous power profile and thus from this observation measures the dead region which is caused by the elastic deformation of the diaphragm, and then influences the actual stroke path by intentionally stopping the stroke motion as a function of the diaphragm deformation so that the error contributed by the diaphragm deformation (with respect to the stroke or the metered volume) is eliminated and the dependency of the metered amount on back pressure is substantially reduced. This improvement is achieved by eliminating errors which are caused by the elastic deformation of the diaphragm due to the operating pressure so that said deformation does not contribute to the metering. By dint of the reduced dependency of the metered quantity on the operating pressure, re-calibrations which otherwise are required when operational parameters such as operating pressure are significantly changed, are dispensed with. Compensating for the diaphragm deformation by observing the magnet current is thus advantageous as, in particular with magnetic drive metering pumps, this is a good reflection of the actual power requirement which can be deduced from the available signals and thus no additional measurements are required.

If, when operating wit a reduced stroke length, the actual stroke which is executed during the forward motion of the thrust member independently of the measured dead region due to the elastic deformation of the diaphragm is influenced by the control device by intentionally ending the stroke motion so that the error caused by the diaphragm deformation is eliminated and so that the linear dependency of the metering quantity on the percentage of the set stroke length is substantially improved, this increases the metering accuracy in this case. This improvement is achieved by eliminating errors which arise through the elastic deformation of the diaphragm due to the operating pressure, so that the amount of said deformation does not contribute to metering and thus the effective stroke length is not strictly proportional to the mechanically set length. Finally, the statements made above are of relevance here.

Excess pressure can advantageously be detected during the metering process and limited if the control device during the forward motion of the thrust member measures the dead region which arises through elastic deformation of the diaphragm and uses it to estimate the operating pressure, and if a predetermined maximum value for the pressure is exceeded, adjusts metering to avoid further pressure increases. Thus, additional accessories which have been necessary up to now, for example excess pressure limiters, can be dispensed with if the metering pump is the only pressure increasing device in the process.

The heat generated within the magnetic drive metering pump is efficiently dissipated if the housing interior, including the magnet and the electronics, is cooled. This enables operations which generate a lot of heat, for example continuous metering at low diaphragm movement speeds, to be carried out.

If a fan is disposed in the interior to cool components therein, the air stream of which is directed over the walls of the magnet and/or the windings of the coil and the inner wall of the magnetic drive metering pump housing and other components, the heat generated by the magnet or said components is guided directly into the interior air and thus onto the housing. The directed air stream improves the heat transfer resistance of the hot components and thus reduces the temperature rise with respect to the air temperature in the interior of the housing. Because of the more even distribution of the heat over the whole surface of the housing, a larger part of the surface acts as a heat sink than without directed cooling. The peak temperature of the housing surface and the components in the pump is thus lower than it would be without cooling.

If part of the air stream is guided over the positional sensor to cool it, then its temperature is essentially kept to the air temperature inside the housing. Since the positional sensor is advantageously mounted fairly close to the magnet to avoid errors in measurements, without such a measure it would be almost as hot as the magnet which, with no cooling by a fan, would be much higher than the general air temperature inside the housing as the magnet is by far the biggest source of waste heat in the apparatus.

If guide surfaces and/or channels are associated with the cover lid, which guide part of the air stream to the positional sensor, then the air stream is more easily directed onto the positional sensor.

If a further part of the air stream is directed onto the electronics installed in the housing cover, the temperature thereof is kept essentially to that of the air temperature inside the housing. Since the electronics built into the housing cover are also mounted relatively close to the magnet, without this measure they would be heated up by the magnet, the temperature of which without cooling would be much higher than the overall air temperature in the housing.

If the magnet shroud inside the housing is arranged so that its circumference can be licked by an air stream, then cooling of the magnet by a fan is rendered easier.

If the coil winding has a reduced number of turns for an increased wire cross section, the coil current can be changed rapidly as required when controlling the motion of the magnet thrust member.

We shall now describe in more detail an embodiment of the invention and some applications in conjunction with the drawings.

FIG. 1 shows a longitudinal section through a magnetic drive metering pump (MD). A housing 1, which is provided with ribs 3 close to the magnet (top side) to prevent the a hot surface from being touched, has a floor plate 4 on its underside. As is generally known, the upper region of the housing 1 contains the magnet shroud 17 of a drive magnet. One face of the housing is closed by a housing cover 5 which is set on the housing 1 and is fixed thereto. In the centre of the housing cover 5 and coaxially with longitudinal axis 18 of the substantially rotationally symmetrical magnet, a manually adjustable adjustment member 7 is integrated into the cover to adjust the stroke adjustment pin 8 which limits the axial movement of the thrust member 20 and thus of the stroke of the diaphragm pump. The adjustment member 7 and other operational elements are protected by a hood 9. Beneath the hood 9 are connections for control wires 10 or for mains cable 11. On the side opposite the hood is a metering head 12 in which diaphragm 13 formed, for example, from plastic, is stretched. The metering head 12 also has an inlet valve 14 and an outlet valve 15, to thrust the metering medium brought into the metering chamber 16 between the diaphragm 13 and metering head 12 via the inlet valve 14 through the outlet valve 15 into a metering channel. The magnetic drive metering pump operates volumetrically, i.e. a predetermined volume is primed on every stroke and then thrust out through the outlet valve 15. The diaphragm 13 is moved via the drive in an oscillating motion. As the description "magnetic drive metering pump" indicates, the drive for the diaphragm 13 is an electromagnet formed by a rotationally symmetrical magnet shroud 17, into which a rotationally symmetrical magnetizing coil 2 is integrated. The magnetizing coil 2 is formed from a rotationally symmetrical coil carrier formed from plastic which is wound with a winding 29 consisting of a plurality of coils formed from lacquered copper wire. The magnetizing coil has, for example, 800 coils with a wire diameter of about 1 mm. The coil carrier and winding are suitably arranged and can be insulated by further insulating materials, such as foil. The magnet shroud 17, a solid rotationally symmetrical body, together with a magnet plate 25 which closes a magnetic circuit from magnet shroud 17 to thrust member 20, surrounds the thrust member 20 with its connecting rod 19 arranged in the centre of the thrust member, which is axially displaceable together with the thrust member 20. To one side of the stroke adjustment pin 8, the connecting rod 19 and the adjustment member 7 act as a manually adjustable stroke adjustment device. The opposite end of the connecting rod 19 cooperates with the elastic diaphragm 13. On the part of the connecting rod 19 facing the stroke adjustment pin 8, the thrust member 20 is fixed to the connecting rod. The core of the diaphragm 13 is fixed to the connecting rod on the part of the connecting rod 19 facing the metering head 12. The connecting rod 19 and thrust member 20 are axially displaceably mounted in a bushing 26 located in the centre of the magnet shroud 17. In a face 24 of the magnet shroud facing the thrust member 20 is an O-ring 21 which absorbs any shocks caused by inner face 22 of the thrust member impinging against opposite inner face 24 of the magnet shroud. Further, within the face 24 of the magnet shroud is a compression spring 23, for example a spiral spring, in a hole facing the face 22 of the thrust member which, with uncontrolled magnets, keeps the thrust member from the inner face of the magnet shroud 24 so that an airgap is formed between the two faces. The magnet shroud has a magnet plate 25 on the side facing the stroke adjustment pin 8, which is fixed to the magnet shroud by screws or push fitting and closes the magnetic circuit from magnet shroud to thrust member. The outer surface of the rotationally symmetrical thrust member is axially displaceable in the magnet plate 25 in a further bushing 27. A cover 28 is fixed on the magnet shroud on the side of the adjustment device to mount the stroke adjustment pin 8, the cover being formed so that on the one hand is sufficiently far from the magnet shroud and thrust member so that the motion of the thrust member is not hindered and on the other hand, directs an air stream produced by the fan 43 onto a positional sensor 36. The adjustment device, stroke adjustment pin and connecting rod are coaxially arranged in the longitudinal axis 18. If the magnetizing coil 2 is supplied with current, the thrust member 20 moves towards the compression spring, narrowing the air gap, and simultaneously the diaphragm is thrust into the metering chamber, with the result that an excess pressure arises in the metering chamber, the outlet valve 15, for example a spring loaded ball valve, opens and the metering medium is thrust into the metering line. If the magnet is then deactivated, the thrust member is moved in the opposite direction to the stroke adjustment pin 8 by the compressed spring 23 which, for example, can be formed as a spiral spring, with the result that the connecting rod 19 associated with the diaphragm moves the diaphragm, and an under pressure arises in the metering chamber 16 which opens the inlet valve 14 so that a further batch of metering medium can be primed into the metering chamber. The alternating oscillating motion of the diaphragm by means of the magnet drive causes the metering medium to be thrust into the metering line.

The position of the unit formed by the connecting rod 19, thrust member 20 and diaphragm 13 is detected by the positional sensor 36, the signal from which is in a predetermined relationship to this position; this relationship may, for example, be a strictly proportional relationship. The signal from the positional sensor 36 thus constantly relates to the position of the part of the movable unit where it is employed. This fixing point is formed by the reference element, which is abstract in this case. Depending on the requirements of the positional sensor, it may be formed as a real additional element to be built in, but it may solely consist of a characteristic shape, for example an edge or face on one of the required components, for example on the thrust member 20.

Figure 6:
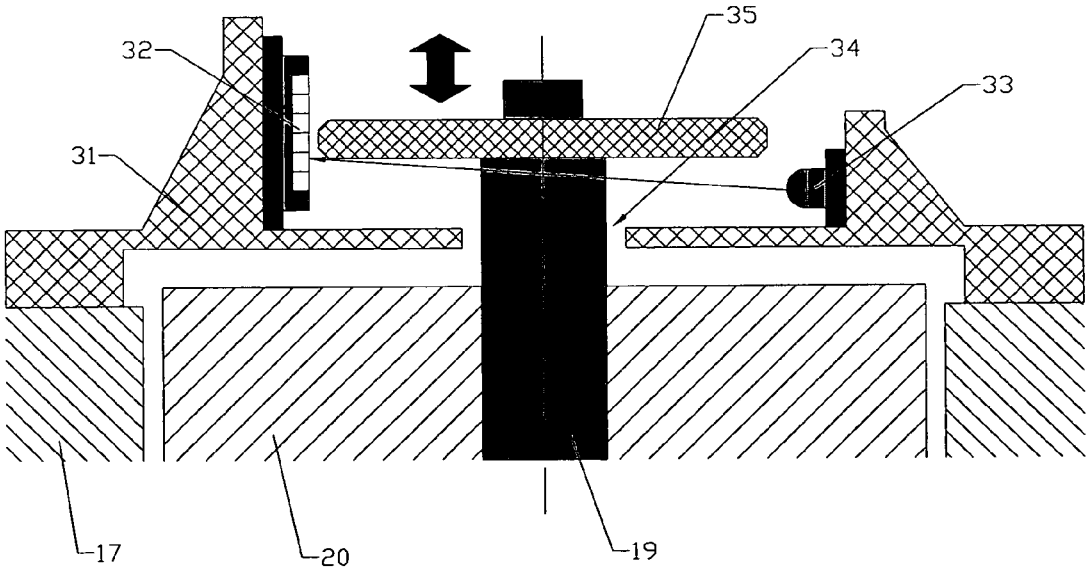
FIG. 6 shows a side view of positional sensor at right angles to axis.

In this embodiment, the magnet shroud 17 has a sensor carrier 31 (see also the illustration in FIG. 6) fixed thereto, which on one side carries longitudinally orientated light-sensitive CCD cells 32 (charged coupled device) and on the opposite side carries a light source 33, for example a light emitting diode.

Figure 5:
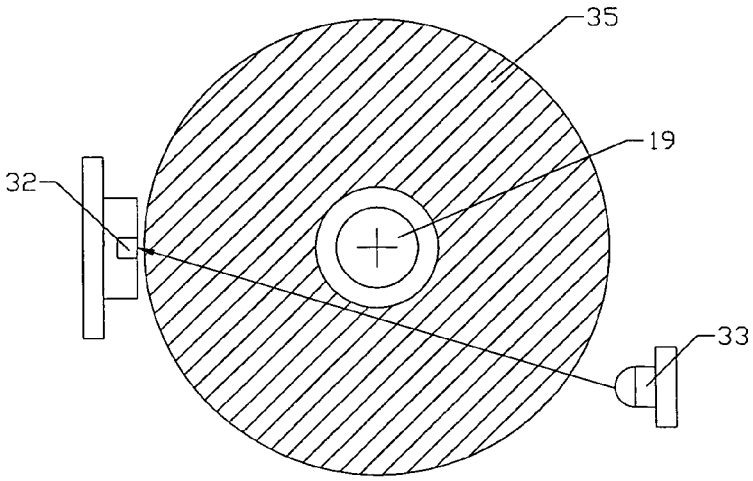
FIG. 5 shows a top view of positional sensor in axial direction.
Figure 7:
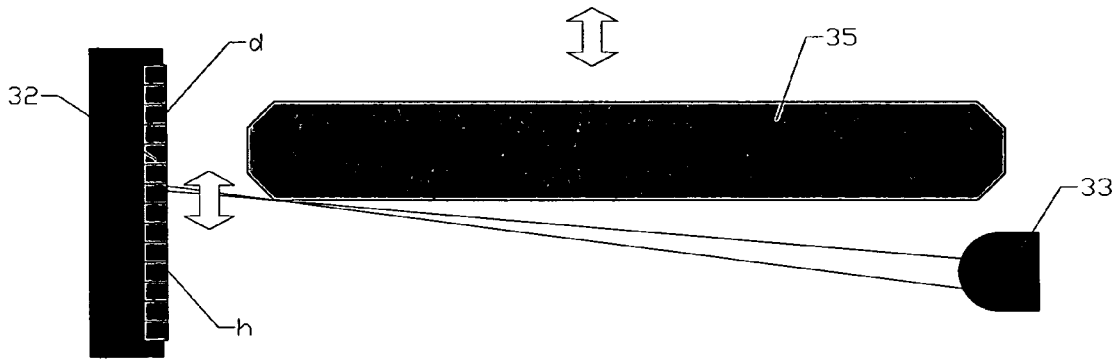
FIG. 7 shows an illustration of shadow region of positional sensor.
Figure 8:
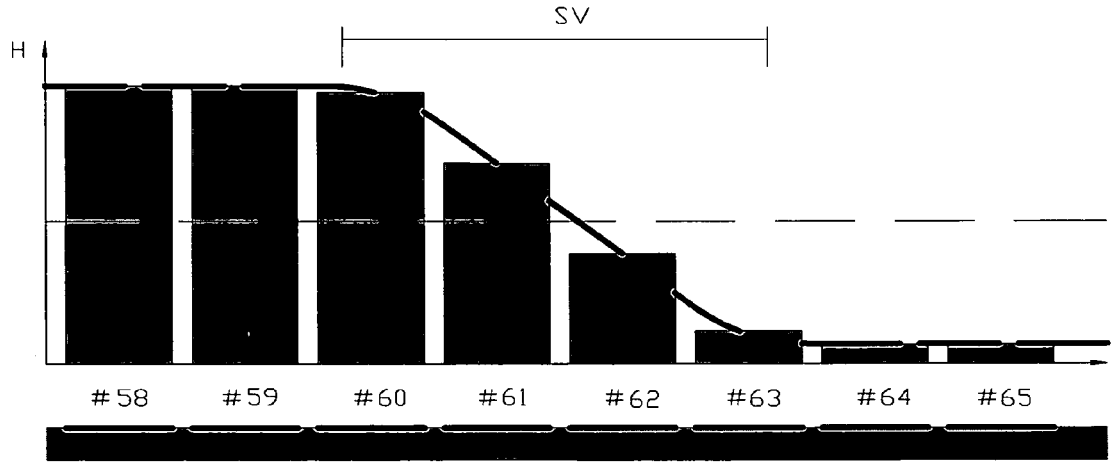
FIG. 8 shows brightness values for pixels in actual shadow transitional region.

The sensor carrier 31 fixed to the magnet shroud has a central opening 34 through which the connecting rod 19 passes. On the part of the connecting rod passing through the sensor carrier 31 is fixed a reference element as a shadow-providing body 35. As the connecting rod 19 oscillates, the shadow-producing body 35 moves too and passes over the light-sensitive cells 32 without touching them. As can in particular be seen in FIG. 5, which Figure shows a top view in the axial direction, the light source 33 must be arranged so that on its way to the light-sensitive cells 32, the light beam is not interrupted by the connecting rod 19; this means, for example, that the light source 33 is arranged over or under the connecting rod 19 and the line of light-sensitive CCD cells 32 is arranged in the axis of the connecting rod 19. As can in particular be seen in FIG. 7, a shadow is cast by the shadow-providing body of the light source 33 onto the light-sensitive cells 32, which divides the cells into illuminated (h) and non illuminated (d) cells. Since the row of light-sensitive cells orientated parallel to the long axis 18, for example 128 pixels, which covers a distance of about 8 mm, is only partially illuminated or in shadow in the transitional region, the transitional situation SV shown in FIG. 8 occurs. The height of the rectangular surfaces shown in FIG. 8 represents the brightness of the pixels. A special process, which will be described below with reference to FIG. 10, exploits this transitional situation in order to accurately determine the position of the shadow-providing body and thus the position of the connecting rod and thus the diaphragm. This measuring device, consisting of the shadow-providing body on the connecting rod side and the light-sensitive CCD cells on the sensor carrier side with the opposite light source, serves to measure the actual position or speed of the oscillating connecting rod and to exploit this information to carry out the functions described.

The connecting rod, which sets the diaphragm moving in an oscillatory movement, covers a distance on each stroke which corresponds to the mechanical stroke length. In order to allow for variations in assembly, the longitudinal extent of the light-sensitive CCD cells must be somewhat greater. This is principally the case with all other positional sensors which may be envisaged.

Figure 3:
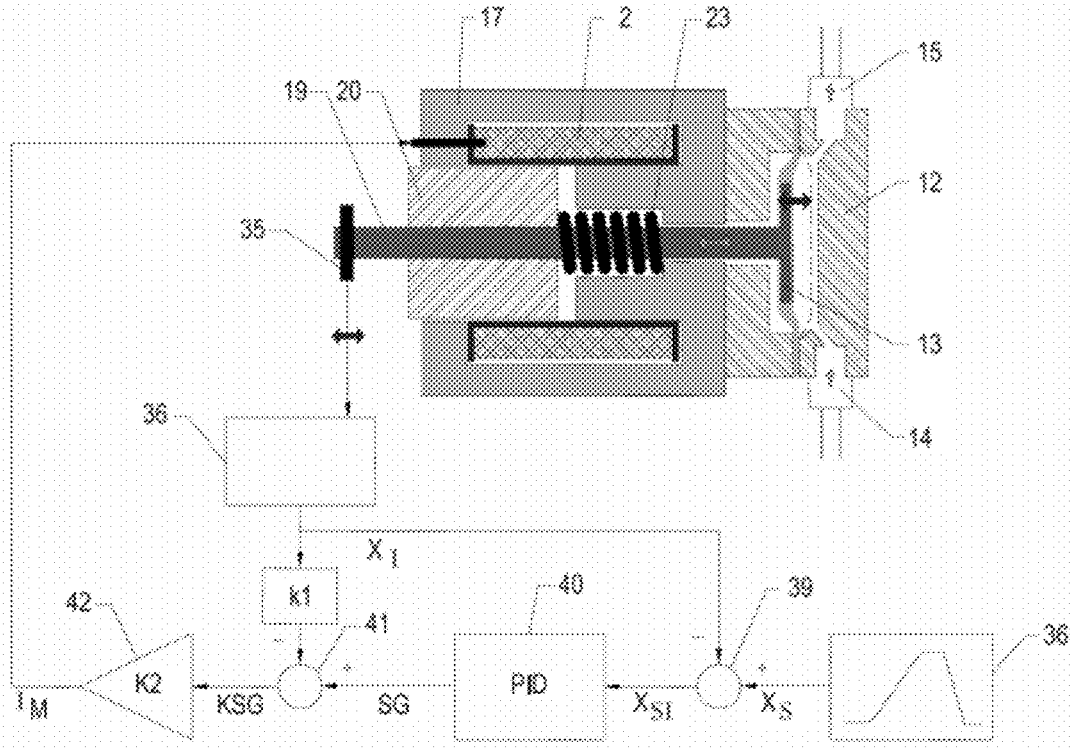
FIG. 3 shows components of positional control circuit.
Figure 4:
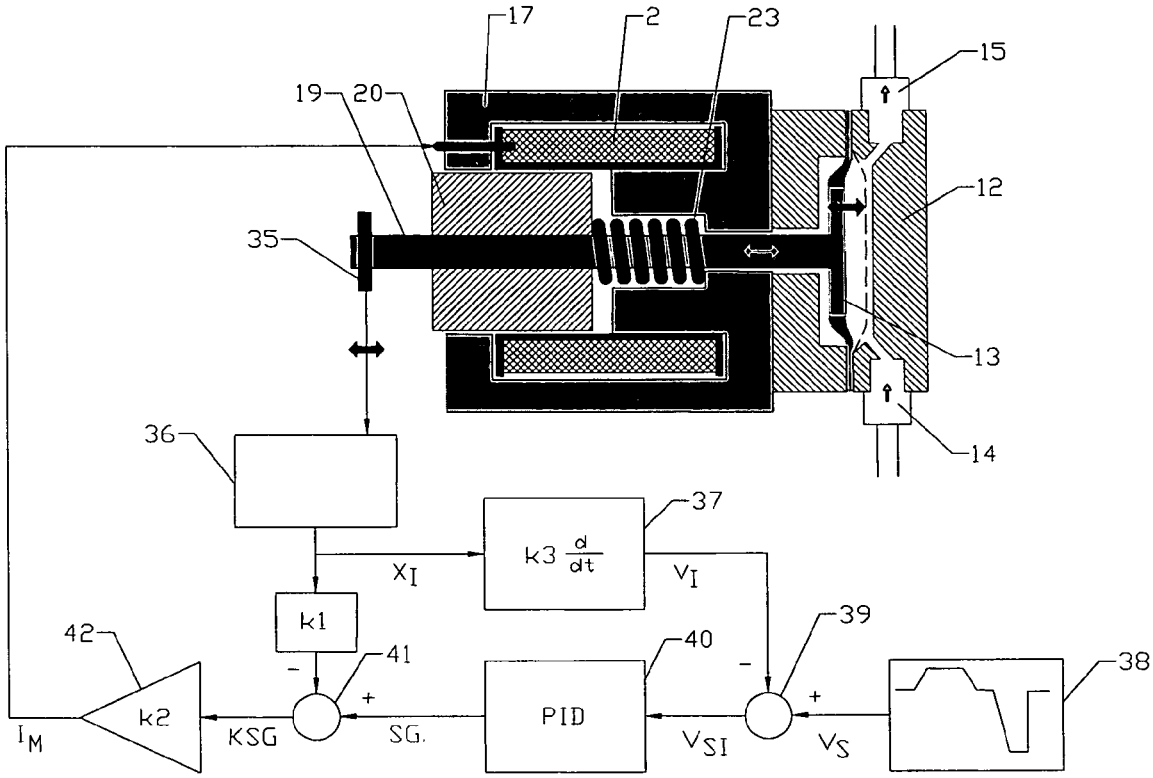
FIG. 4 shows components of speed control circuit.

As explained in FIG. 3 and FIG. 4 in particular, the control circuit formed by the sensor and the control device require the following mechanical and electronic components. The abbreviations used in the two diagrams mean the following:

$x_S$: nominal value for position of thrust member;
$x_I$: actual value for position of thrust member;
$x_{SI}$: deviation for position of thrust member;
vs: nominal value for speed of thrust member;
$v_I$: actual value for speed of thrust member;
$v_{SI}$: deviation for speed of thrust member;
SG: controller output;
KSG: corrected controller output;
$I_M$: magnet current.

The stationary part of the magnet drive consists of the magnet shroud 17 with the magnetizing coil 2 and the magnet plate 25 each with inserted bearing bushings 26 or 27 for the unit formed by thrust member 20 and connecting rod 19. The moving parts of the magnet drive, the motion of which is to be controlled, consist of the connecting rod 19 with which the thrust member 20 as the drive element and the diaphragm core 30 are fixed. The recuperating spring 23 returns the thrust member after a working stroke and thus operates priming. The outer ring of the diaphragm 13 is fixedly mounted in the metering head 12, which metallic diaphragm core 30 injected into the diaphragm moves the central surface of the diaphragm in the metering head as the thrust member. The inlet valve 14 closes on the priming side, the outlet valve 15 on the pressure side of the metering head and each one offers a connection possibility for the external pipework. A reference element is, for example, connected at the end facing the metering head with the connecting rod 19, the position of which in the present case is detected by a positional sensor 36 which operates without touching. In the embodiment shown, the reference element is a shadow-providing body 35 in the form of a plate and the positional sensor is a lightbox-like arrangement consisting of the light source 33 described above cooperating with a series of light-sensitive cells 32, which determine the position of the plate 35 optically, and thus without touching, by its shadow.

The positional sensor 36 produces an actual signal $x_I$ which is proportional to the position of the reference element. In the case of a speed controller, in this embodiment it is fed through a time differentiator 37 ($dx_I/dt$) and thus additionally produces an actual signal $v_I$ which is proportional to the speed. Other methods clearly would be suitable for the control step, which could produce a signal proportional to the diaphragm speed. Depending on the type of control and the metering requirements, a time dependent profile for the nominal value 38 of position $x_S$ or the speed $v_S$ is produced. A variance comparison 39 determines the variation as a positional variation $x_{SI}=(x_S-x_I)$ or a speed variation $v_{SI}=(v_S-v_I)$ and the result is given on a PID control (proportional, integral and differential control). The output, namely the controller output SG, corresponds to the value for the drive. To improve the stability of the controller, prior to further processing, a positional correction 41 takes into account the fact that as the magnet advances it requires less and less current for a given force. The positional correction 41 arises by subtracting a positional proportional fraction from the start signal 4. The PID controller 40 produces a corrected controller output, KSG. An amplifier 42 holds the power levels and supplies the coil 2 with the required current. The degree of position dependent current correction, transformation of the nominal values into a real magnet current and if necessary the deflection constant for the formation of the speed signal $v_I$ are set by the three proportionality factors k1, k2, k3. The factor for the position-dependent correction, k1, is selected so that the degree of current reduction is as close as possible to the magnet steady state characteristic; the two factors k2 for the amplifier or k3 for the speed signal deviation, can be selected from practical considerations, such as operation with the best available ranges for the dimensions used.

FIG. 3 shows the control circuit for a positional regulator, and FIG. 4 shows the control circuit when using a speed controller. The control circuit described transfers the predetermined time dependent profile for the nominal value for the position $x_S$ or the speed $v_S$, clearly in the context of its possible control regulation. Establishing the real profile for the position, speed or acceleration and switching between these operational modes occurs as described below, for example, taking into account the functional limitations of the controller such as control speed, achievable accuracy, etc.

With such a control, a magnetic drive metering pump can be used to predetermine the desired speed of the diaphragm 13, and thus to control the effective flow speed of the metering medium.

The diaphragm position can thus be directly controlled. This function allows the positions to be obtained in selected phases of the metering process and if necessary also when stationary.

By controlling the motion by means of a positional indicator, in contrast to uncontrolled operation, changes in the operational parameters can be responded to, which changes crop up over time or occur because of environmental considerations or variations, i.e. statistical deviations in the production series, and can minimize their damaging influence. Examples which can be cited are the diaphragm rigidity or the viscosity of the metering medium. Both require magnetic force which must be added to the force for creating the operational pressure on the diaphragm surface. By determining their effect and subsequently regulating the magnetic current, these damaging influences can be compensated for. An unregulated magnetic metering pump with a preset magnet current, even if this is controlled to keep it stable, still suffers from such influences.

Further, controlling the movement by means of a positional indicator makes it possible, in contrast to the spontaneous metering process on unregulated operation, to react to internal and external influences which will be described below, and to establish operational conditions which can exploit or avoid particular hydraulic conditions on metering. An example is the function of the cavitation protection on priming which is described below.

Individual implementations for a magnetic drive metering pump of the type described above will now be described, which pump has a positional sensor which can influence the motion of the diaphragm by controlling and adjusting the magnetizing coil current.

To describe these possibilities of application, FIGS. 14 to 19 show oscillograms for the appropriate metering processes. In each diagram, the upper curve, Pos, shows the diaphragm motion on a scale of 0.5 mm/division; the end buffer point EPos is at the upper edge of the diagram. The rising part of the Pos curve corresponds to the metering stroke; the falling part to priming. The lower curve $I_M$ shows the accompanying magnet current with a scale of 1 A/division; the zero line $I_{Mo}$ lies at the lower edge of the diagram. The descriptions "Pos", "EPos", "$I_M$" and "$I_{Mo}$" are shown in FIG. 14 and FIGS. 15 to 19 show similar means, although they are not specifically mentioned.

Avoidance of loss of flow in highly viscous media can be accomplished by regulating the speed of the diaphragm 13, in particular with highly viscous media (for example lecithin), which can limit flow losses in the valves and other tight spots. High flow speeds in such media have a negative influence on the metering accuracy through additional pressure drops as a result of flow resistance. In addition, it is advantageous here if the valves have more time to open and close because of the limited speed. Both effects improve the metering accuracy in highly viscous media.

To achieve this, during the entire metering process, the diaphragm speed is limited to a selectable maximum value. This maximum speed depends, inter alia, on the viscosity of the actual medium to be metered and is, for example, in the form of several predetermined values which depend on the application selected by the operator or are provided directly.

With media which readily evolve gas (for example chlorine bleach), particularly on priming, but also in the metering stroke, too high a flow speed can cause cavitation at restricted spots by a local drop in the vapour pressure which is dependent, inter alia, on the chemical composition of the metering medium and on its temperature, resulting in increased wear. Cavitation can be avoided by limiting the speed during priming too, i.e. return of the diaphragm, by regulation to a value which is substantially below a critical flow speed. A curbing force is set by the control circuit for the magnet to act against the force of the recuperating spring 23 to limit the diaphragm speed to correspond to that of the medium, for example to 1 mm/50 ms.

Figure 14:
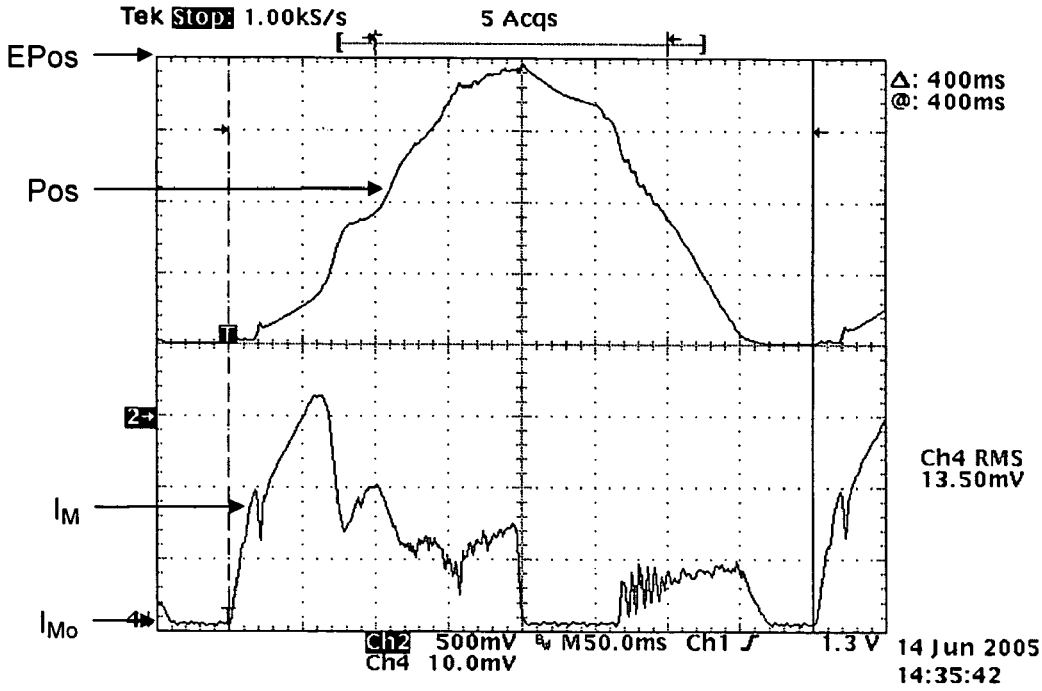
FIG. 14 shows an oscillogram of metering process with cavitation protection on priming.

FIG. 14 shows, as an example, an oscillogram of this metering process for a stroke period of 400 ms, a stroke length of 2 mm and a nominal operating pressure of 10 bars with active cavitation protection on priming.

Figure 15:
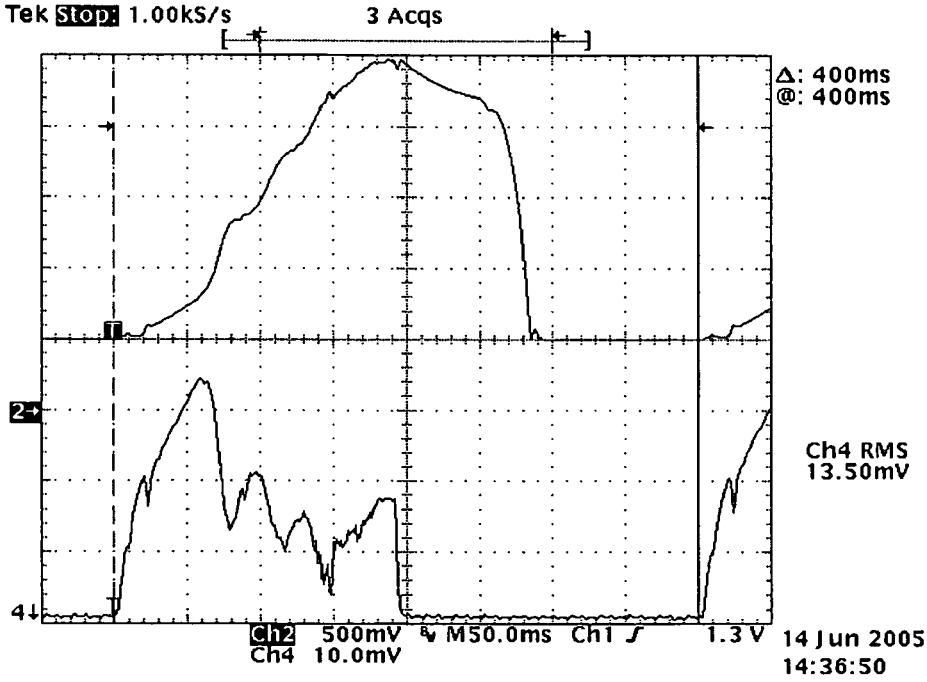
FIG. 15 shows an oscillogram of metering process without cavitation protection.

FIG. 15 shows, for the same conditions, the oscillogram for a metering process for free priming.

During priming in FIG. 14, the speed is limited, by driving the magnetizing coil, to a value of about 1 mm/50 ms, i.e. the control device prevents the diaphragm driven by the recuperating spring 23 from being driven faster back than at the set speed; the diagram shows the magnet current during the priming phase, which establishes this. In FIG. 15, the magnet is not driven during the priming phase—in this case there is no magnet current flow during that phase. This results in a much higher speed, which can results in cavitation.

Electronic Stroke Length Adjustment

The invention allows the mechanical device for regulating the stroke length (adjustment member 7 and stroke adjustment pin 8) to be dispensed with. To this end, the control device is told the desired stroke length electronically, for example input by an operator. If the desired stroke length is executed, the position reached by the diaphragm 13 is stored and returned to the priming phase. The diaphragm can still stop briefly in the position dictated by the nominal stroke length in order to allow the outlet valve 15 sufficient time to close, or it can immediately return after executing the nominal stroke length.

Figure 16:
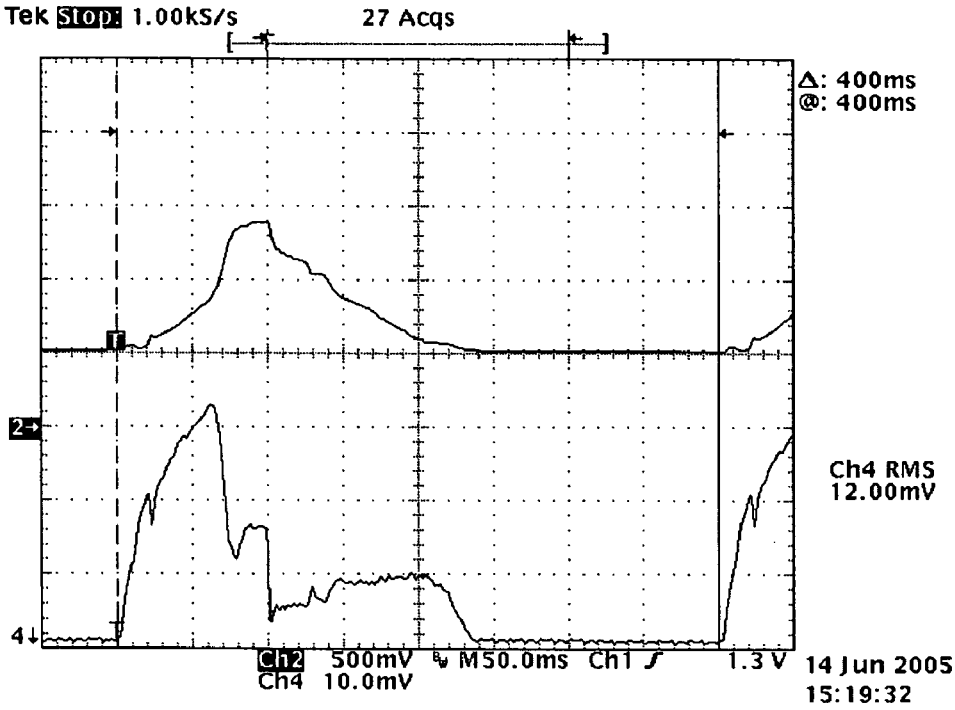
FIG. 16 shows an oscillogram of metering process with stroke length electronically limited to 0.9 mm.

FIG. 16 shows, as an example, the oscillogram for a metering process for a stroke period of 400 ms and a nominal operating pressure of 10 bars with an electronically limited stroke length of 0.9 mm. As can be seen from the diagram, the diaphragm does not travel completely to the end buffer at the upper edge of the diagram, but is stopped after traveling 0.9 mm and then carries out the priming procedure.

Detection of Position of Adjustment Control for the Stroke Length

Prior art metering pumps often operate by calculating the metering stroke directly from the volume set in the displacement chamber (stroke length) into a metered total volume and displaying this, for example, as the volume flow in the l/h unit. For such functions, knowledge regarding the stroke length set by the operator is required as the volume metered per stroke depends thereon. For this reason with prior art metering pumps the position of the stroke adjustment device must be transformed by a separate sensor into an electrical signal and read into the control system. One example for a practical embodiment would by a rpm reader on the stroke adjustment member.

A motion controlled metering pump does not require an additional sensor as it can detect the actual diaphragm path during the stroke using the on board positional sensor. By producing the difference between the two positions in the end positions, which can be measured after reaching the mechanical buffer, as soon as the motion stops, the stroke length can be calculated directly and is available for further processing.

Avoiding Pressure Peaks

In prior art magnetic drive metering pumps, the metering medium is accelerated fairly quickly when the outlet valve opens because this latter is relatively abrupt, resulting in a pressure peak. Further, the diaphragm and thus the metering medium in a prior art magnetic drive metering pump moves through the decreasing airgap very quickly particularly in the last part of the stroke motion, which means that the thrust member impinges hard against the buffers and high instantaneous flow speeds or pressure peaks occur.

A motion controlled magnetic drive metering pump as described can avoid these negative effects whereby the speed until the outlet valve is opened and shortly before reaching the end buffers is intentionally reduced and the metering thrust member is curbed in the final part of its path shortly before the buffer. In a variation, there is also the possibility that the buffer is not impinged against, but the diaphragm motion is intentionally stopped shortly before reaching the buffer. Thus, the O-ring 21 can be dispensed with or be substantially smaller in dimension. Furthermore, operational noise is substantially reduced.

Figure 17:
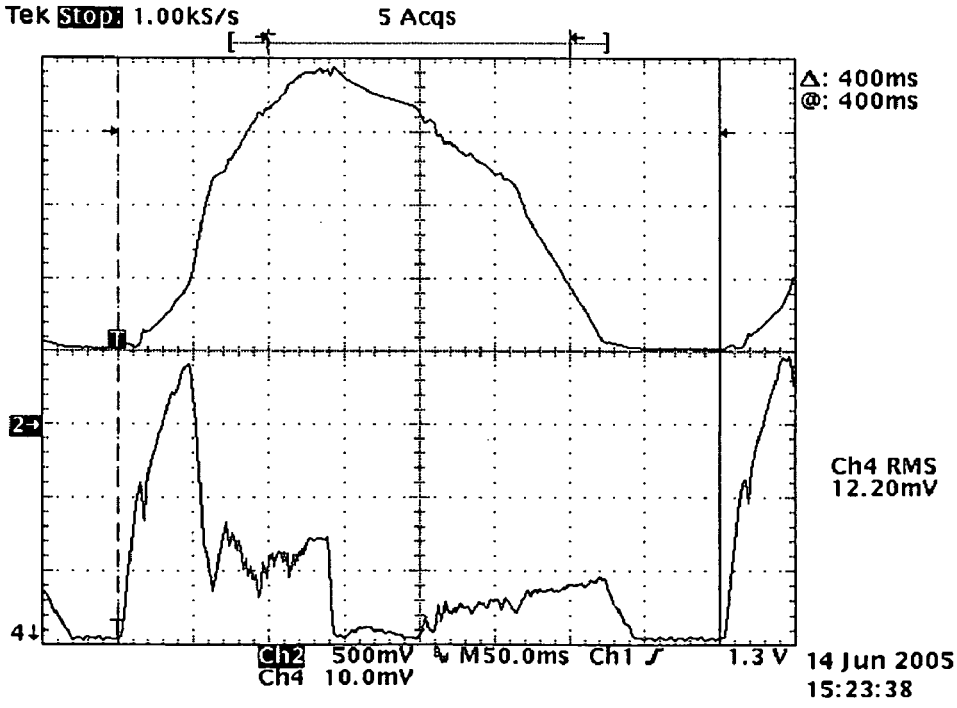
FIG. 17 shows an oscillogram of metering process with curbed end buffer impingement.

FIG. 17 shows, as an example, the oscillogram for a metering process with a stroke period of 400 ms, a stroke length of 2 mm and a nominal operating pressure of 10 bars with curbed impingement against the end buffer. As can be seen in the diagram, the speed of the diaphragm is reduced before it reaches the end buffer at the upper end of the diagram to a value of about 0.6 mm/50 ms.

Avoiding Overstraining

In prior art magnetic drive metering pumps, overstraining occurs with a very low back pressure. It arises because at the end of the metering stroke, the outlet valve does not close immediately but the metering medium flows further through the metering head by a sort of siphon effect due to its high speed in association with its momentum, and opens the inlet valve prematurely so that an excess amount of metering medium arrives in the outlet line. Because of overstraining, uncontrolled pumps can only be used above a minimum operating pressure of 2-3 bars, for example; in order to ensure this, a pressure retaining valve is usually installed in the outlet metering line.

With a motion controlled magnetic drive metering pump, electronic limiting of the diaphragm speed shortly before reaching the end buffer or during the entire metering stroke can practically completely avoid the siphon effect responsible for overstraining. The operating range of the metering pump is thus extended to low operating pressures, and a pressure retaining valve can be dispensed with for most practical metering situations.

The motion corresponds to that shown in FIG. 17, with the exception that it concerns a situation with a particularly low operating pressure.

Slow Metering to Avoid Variations in Concentration

For applications in which good mixing with the process medium stream is required, dispensing of the metering medium into the process must be as even as possible.

With a motion controlled magnetic drive metering pump, the time available, which is given by the repetition frequency of the metering stroke, can be distributed so that the remaining time after priming is subtracted, even up to a brief rest, and can be exploited to the maximum for the forward motion. The speed to be regulated is thus calculated from the path covered (set stroke length) and the available time. The amount of use of the time available depends on the metering requirements and also on the properties of the cooling design, which has to accommodate the increased heat produced because of the almost uninterrupted magnetic drive.

Figure 18:
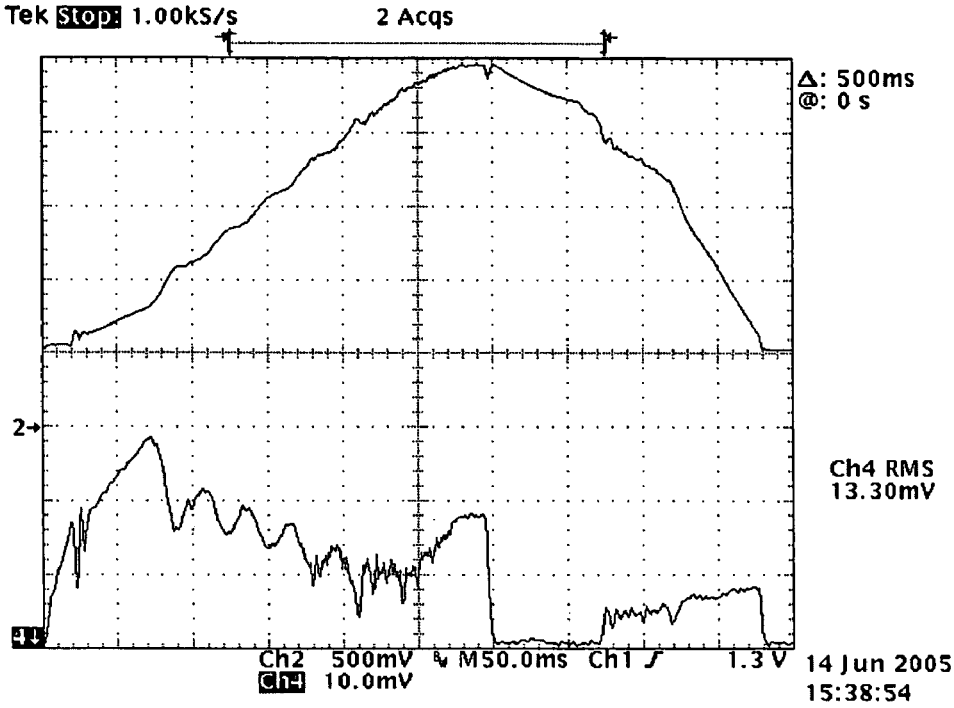
FIG. 18 shows an oscillogram of metering process with slow metering.
Figure 19:
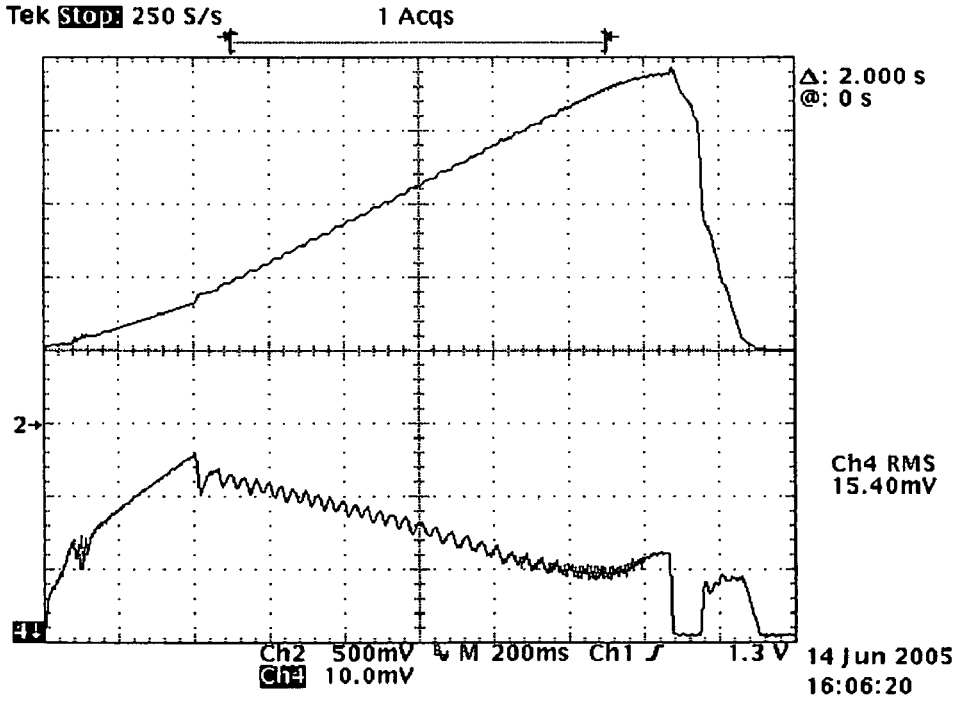
FIG. 19 shows an illustration of metering motion and accompanying magnet current requirement on slow metering with cavitation protection on priming.

FIG. 18 shows, as an example, an oscillogram for a metering process with a stroke period of 500 ms, a stroke length of 2 mm and a nominal operating pressure of 10 bar in slow metering mode, combined here with slowed priming to protect against cavitation. As can be seen in the diagram, the total stroke period of 500 ms is adjusted to a pressure stroke of more than about 250 ms and a priming stroke of more than about 180 ms, which taken together gives 430 ms or 86% of the total stroke period; the remaining 70 ms are exploited to separate the motion phases.

Particular applications also require the possibility of metering very small amounts over very long periods as evenly as possible, to produce an almost continuous metering. For these cases, in the prior art motor-driven metering pumps are employed which, for example, have a step motor and a self locking gear. A complete stroke is carried out in such metering pumps with a reduced rotary speed or distributed over several steps with intermediate rest periods, and at the end of the complete stroke a complete (fast) priming phase is carried out, and thereafter the metering process continues in the manner described.

The invention can satisfy these requirements by a simple and thus inexpensive construction of a magnetic drive metering pump. The diaphragm 13 must be operated in a controlled manner with a very low speed along the stroke path and at the end of the stroke, a full priming phase is carried out at the normal speed so that the total stroke period can be almost entirely used for the pressure stroke. The speed can lie in a very wide range from, for example, 1 mm/min to 1 mm/s and beyond.

In one embodiment, small rests can be inserted between partial motions wherein the diaphragm 13 is held in a constant position. This provides the outlet valve 15 with clearly defined conditions which are not available with extremely slow near stationary motion, which produce large strains on the outlet valve 15. The thermal load is practically identical in such variations to the linear movement version as in both cases the operating pressure uses a quasi static magnet in force.

A further embodiment can reduce the thermal load, wherein the stroke motion as in the previous case is divided into small part movements and in the stationary phases therebetween the diaphragm 13 is also reversed over a small deloading path in order to reduce pressure by cleanly closing the outlet volume 15 and thus simultaneously to reduce the magnetic power requirement during the stationary phase. The partial strokes are then completed by the amount of this deloading path so that in total an unchanged stroke path is executed. The deloading path must be shorter than the (pressure dependent) displacement path of the diaphragm to prevent partial priming from being carried out between the partial strokes on reversing and thereby reducing accuracy. These embodiments advantageously operate in connection with the pressure compensation described below as this measures the deformation of the diaphragm and thus the deloading path can be better matched to the actual conditions.

Pressure Compensation

With controlled motion, the control system is in equilibrium (i.e. in a steady state) at any point with a magnet current, which the external (time dependent) forces cover.

This magnet current requirement results from the instantaneous power and from the airgap remaining between the inner face of the thrust member 22 and the inner face of the magnet shroud 24. A characteristic current $I_M$ is produced during the metering stroke, as shown in particular in FIG. 19. The oscillogram shown shows, for example, the current with an over about 2.0 s stroke divided into a stroke length of 2 mm and a nominal operating pressure of 10 bars. At the end of the stroke, slower priming is carried out to protect against cavitation, which is of no consequence for the observations described below. The time scale for the diagram reflects the slower stroke.

The lower curve $I_M$ initially exhibits a relatively steep rise in current until the diaphragm 13 starts to move. After a brief over swing, the current rises with continued motion until a current maximum is reached. From this point, the current falls off over the remaining path in a substantially linear manner until the end buffer EPos is reached. In the priming phase, a further current prevents the diaphragm from reversing too quickly to protect it from cavitation. The following conclusions can be drawn from this characteristics process:

The initial fast rise in current (in the diagram from time 0 to 80 ms) is caused by the inductive behaviour of the magnetizing coil 2, which cannot experience a change in current in zero time, and the speed of the control device, which must initially adjust to the required motion. The increasing current increases the magnet force until the external forces are overcome and the thrust member 20 together with the diaphragm 13 starts to move. In this phase, the magnetic field is built up.

The almost linear rise in current after the initial control adjustment to the actual maximum current (from 80 ms to 400 ms in the diagram) increases the power requirement as the magnet current must reduce for constant force and reducing airgap. In this phase, in the metering chamber 16 with the outlet valve 15 still closed, the internal pressure rises continuously, wherein the diaphragm 13 exercises increased force and deforms elastically. In this process, the diaphragm core 30 moves into the metering chamber 16, increases pressure, and the elastic flexible region of the diaphragm gives by the same extent under pressure against the motion of the diaphragm core. The diaphragm 13 deforms into itself, and in total practically no deformation takes place, because the metering medium is practically incompressible and at this time both valves are closed. At the end of this phase, the chamber pressure corresponds to the external operating pressure. The path that has been traversed corresponds to the diaphragm deformation, i.e. the dead region at the start of metering, and does not in practice contribute to metering. The actual position is stored and taken into consideration as the measured deformation in the further metering process (in the example, the dead region is 0.3 mm).

At the equilibrium point, the pressure side outlet valve 15 opens. The pressure on the diaphragm 13 is now practically identical with the external operating pressure and does not rise further, and as a result the magnet current produces a constant force with a decreasing remaining air gap and on continued motion becomes continuous (from 400 ms in the diagram). Since the flow speed of the metering medium when using the described process remains negligibly small, no pressure variations occur, so the current profile again reflects the magnetic force (see FIG. 19).

The magnet current after reaching equilibrium and opening the outlet valve 15 is no longer relevant to the measurement of the diaphragm deformation described here. When measuring the diaphragm deformation, as an example, a linear forward motion can be controlled initially with a nominal value for speed which is optimized for measuring the current maximum, and immediately after capturing and storing the diaphragm deformation can be switched to a deviated motion path, which is matched to the requirements of one of the described functions. As an example, at the beginning of the stroke, a relatively short time period for the diaphragm deformation can be measured and the actual metering stroke can be carried out over the remaining available time as a slow metering.

The diaphragm deformation measured by observing the magnet current can now be used as the basis for correcting the mechanism stroke length HL and can be calculated into the diaphragm path to be executed. To this end, the point at which the current is a maximum is established as the actual start point for metering, from which the desired stroke length is executed and the stroke is then ended before the mechanical end buffer by the thrust member 20 impinging against the inner face of the magnet shroud 24. For operating pressures below the nominal pressure, the diaphragm deformation is smaller and the last part of the possible mechanical path for the thrust member is not used, i.e. the airgap is not completely closed.

Diaphragm deformation is, inter alia, dependent on the material properties and can thus change on ageing or by variations in manufacture. These two aspects are taken into account because the correction in the diaphragm deformation does not use predefined values derived from the module parameters but captures the actual conditions afresh on each stroke.

The magnet current can be captured, but it is not actually necessary. Since the amplifier 42 transforms the corrected controller output KSG as a magnet current into a magnet coil current $I_M$ using factor k2, the corrected controller output KSG can be used directly as a reflection of the magnet current, and this can be used for further processing without making further measurements from signals from the control system.

Improvement to Metering Accuracy for Partial Stroke Operation

The process described above to determine the deformation of the diaphragm on the basis of its elasticity by observing the magnet current also allows the accuracy during partial stroke operation to be improved.

Figure 12:
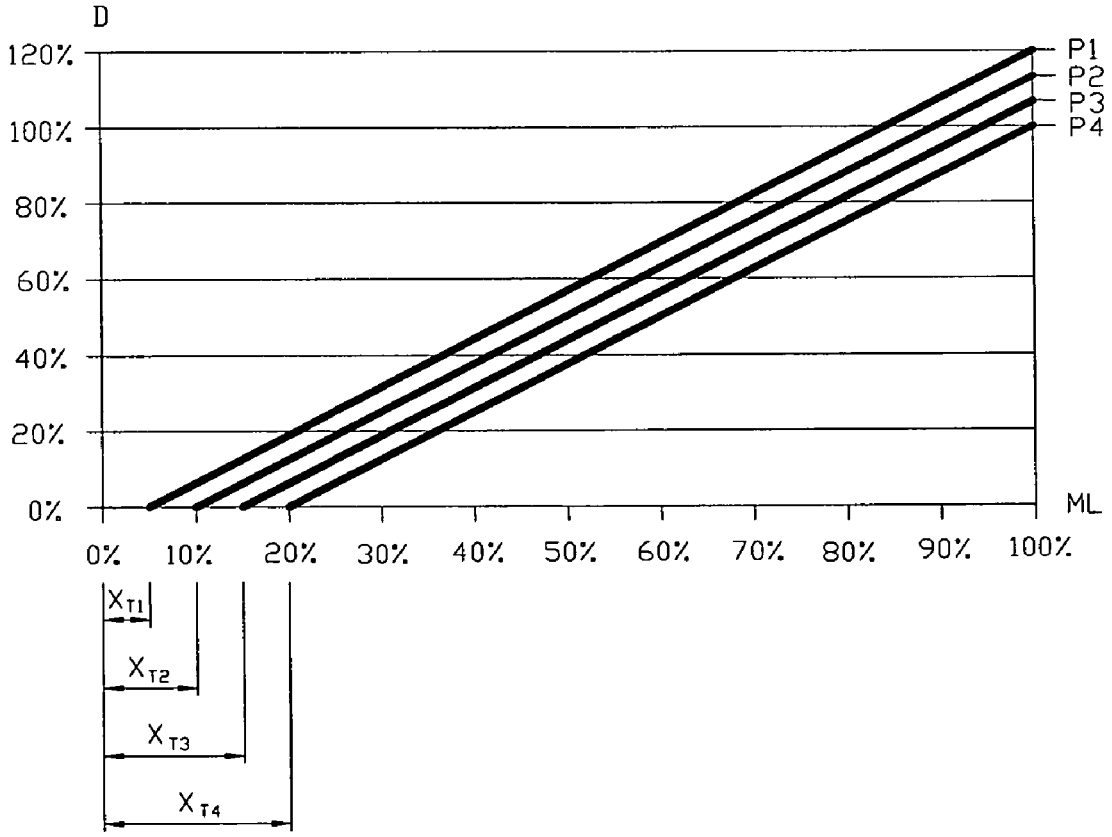
FIG. 12 shows an illustration of metering performance as a function of mechanical stroke length and operating pressure.

For a prior art magnetic drive metering pump, metering is not only dependent on pressure but also under partial stroke conditions is not strictly proportional to the mechanical stroke length. Further, effective metering begins at the stroke only after the initial dead region from the point at which diaphragm deformation is maximal. If a steady state characteristic is produced which shows the metering profile as a function of the mechanical stroke length, a linear rising curve is produced which only shows a real dose after a minimum stroke length corresponding to the dead region of $x_{T1}$, $x_{T2}$, $x_{T3}$, . . . $X_{Tn}$ (see FIG. 12). Since this minimum stroke length corresponds to the diaphragm deformation, it is thus dependent on the operating pressure $p_1$, $p_2$, $p_3$, . . . $p_n$.

This shift $x_{T1}$, $x_{T2}$, $x_{T3}$, . . . $X_{Tn}$ in the steady state characteristic means in the prior art re-calibration under real working conditions, insofar as the current stroke length is substantially changed, as the new metering performance cannot be determined with sufficient accuracy by a proportional calculation from the current and new stroke lengths.

If the diaphragm deformation as described above is compensated for, the proportional errors in partial stroke operational mode are also eliminated, and so the metering pump can be operated over practically the entire useful range of stroke lengths from 20% to 100%, for example, without having to carry out the re-calibrations necessary until now in a prior art metering pump which require an adjustment of the stroke length by more than 10%, for example, in order to ensure the specified metering accuracy.

Estimating Operating Pressure Using Electrical Dimensions; Electronic Pressure Limitation; Detecting Over Pressure By laying down values for the material properties of the diaphragm, measurement of the diaphragm deformation described above allows sufficiently accurate conclusions to be drawn regarding the operating pressure in order to carry out additional functions which will be described below.

Unregulated prior art magnetic drive metering pumps have a fundamental property that the force developed by the drive magnet during the stroke motion increases steeply by dint of the decreasing air gap. The magnet current is measured so that the force in the start point, i.e. with a large air gap is sufficient for the nominal operating pressure. At the stroke end, a multiple of this force is applied. This has the result that with defective pipework, for example accidentally closed blockage members, the pump can develop a pressure which is greatly above the maximum operating pressure if it is operated with a reduced stroke length for a partial stroke.

In magnetic drive metering pumps which control the diaphragm motion by means of a positional sensor and regulating the diaphragm motion, however, the position of the thrust member and thus the length of the remaining air gap is known at all times. Together with the known current force path steady state characteristic of the drive magnet it is possible to match the maximum current by which the control device can drive the magnet during the metering stroke to the actual diaphragm position dynamically so that the developed maximum force is limited to a near constant value over the whole path. Thus the maximum pressure developed is much more precise and independent of the set part stroke length, so that the use of additional pressure limited conditions can be dispensed with in many cases.

The application of the invention also makes it possible for the control system for the metering pump, through the measurements, to secure knowledge regarding the excess pressure so that a reaction to this condition is possible, such as the production of an alarm and/or stopping the pump, without knowledge of external conditions.

The accuracy of said functions depends on the reproducibility of the basic material properties, above all of the diaphragm. This accuracy can be increased by one-off calibration in the production phase or in actual application, in which the metering pump at a known pressure is driven and then, the relationship between this known pressure and the diaphragm deformation forms the basis for further calculation. The possibilities described above of the positional indicator together with the control system show that by using a positional sensor, for example on the connecting rod or the thrust member, the actual position of the diaphragm can be determined and monitored during the whole stroke and priming process. Establishing the position and monitoring leads to the fact that the process can be precisely controlled by means of measuring the actual values, resulting in the described advantages.

Cooling the Magnet and Further Components

In contrast to magnetic drive metering pump of the prior art, in specific operational modes such as slow metering of the magnetizing coil 2 for a substantially longer time to continuous current operation, result in a much higher heat losses. Particularly when installed in a plastic housing, the problem of conducting heat away arises. Magnetic drive metering pumps are frequently installed in spray water protected plastic housings in order, in typical use, to be insensitive to aggressive chemicals. In these cases, with controlled magnetic drive metering pumps, cooling by guiding the heat through the housing wall without exchanging air must be ensured.

With prior art magnetic drive metering pumps, the magnet is built into the housing 1 so that the magnet shroud 17 has as much of its upper surface in heat conducting contact with the housing 1 as possible; this contact can, for example, be improved by injecting around the magnet on manufacturing the housing. Heat dissipation occurs partially by dint of this surface from the magnet shroud 17 to the inner wall of the housing 1. The other part of the heat from the magnet together with the heat from other components is dissipated into the interior of the housing into the gap inside the housing, which warms up. This heat is transferred by convection to the inner wall of the housing from which it is guided, together with the directly coupled part of the heat from the magnet, through the wall of the housing 1 and finally, dissipated by convection from the outer wall of this housing to the surrounding air. Because of the multiple transitions exclusively by convection and the usually poor thermal contact of the magnet shroud 17 with the housing 1, for example due to fit, to badly formed edges of the plastic housing etc, the magnet gets very hot in prior art uncontrolled operation; the temperature can be over 100° C. The outer wall of the housing in particular is very hot in the region above the magnet, which usually has ribs which, inter alia, act to protect against touching, wherein only a small section of the total surface, namely the upper part of the rib spine, can be touched. Since on touching the housing ribs 3 transfer much less heat to the skin than if a smooth surface is touched, the temperature of the housing appears much lower. The ribs also form relatively small air channels and hinder convection, thereby deleteriously affecting the heat dissipation of the housing, which increases the surface and the internal temperature.

Figure 13:
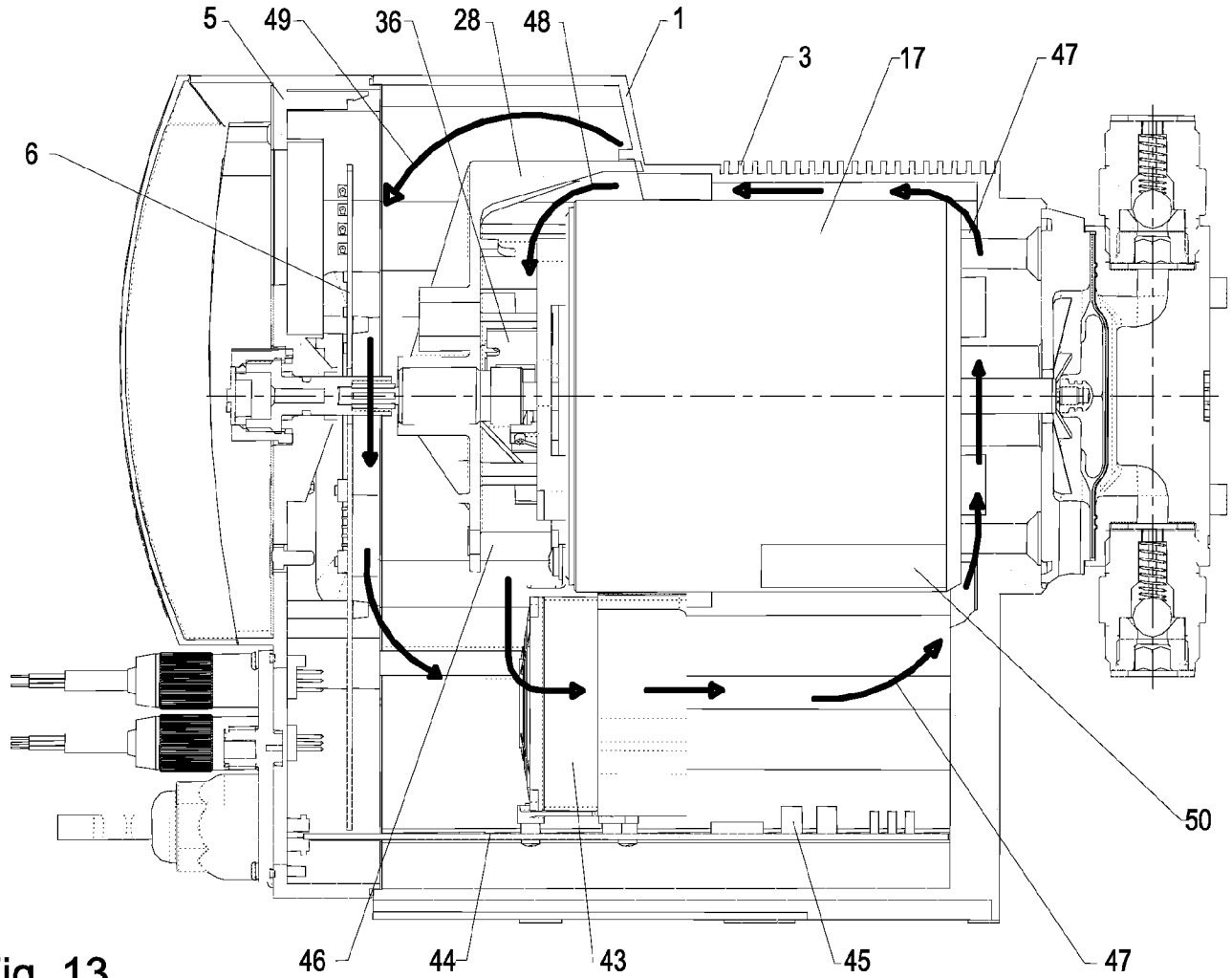
FIG. 13 shows an illustration of cooling concept.

With a magnetic drive metering pump of the invention, the structure used until now to remove heat is not sufficient because of the problems outlined above, even with slow strokes. Much more effective heat dissipation is required which is achieved by guiding the internal air using a fan. FIG. 13 shows the cooling concept in more detail. In the upper part of the housing 1, the magnet is centred by several, in this case three links 50 so that over as much of its circumference as possible the magnet shroud 17 and its faces have a small clearance of at least 5-10 mm from the housing 1, for example. In the lower part of the housing is the electronic control system 44 and a fan 43 so that the fan produces a circulating stream 47 of air which moves around the magnet shroud 11 and the on board electronic modules 45 which are to be coded. The fan 43 can, as described below, be a module for the electronic control system 44 or a module standing alone in the housing 1. Naturally, the fan can be located at other places; what is important is that the air movement ensures that heat is fed away because the heat is brought to the inner wall of the housing in as even a manner as possible and is then used to dissipate the heat. It should also be noted that the fan is outside the housing and sealed thereto.

The arrangement of the links 50 and the space between the magnet shroud 17 and the housing 1 forms one or more flow channels which directs the air stream 47 as effectively as possible over the whole surface of the magnet and directs air to all parts of the inner wall of the housing 1. The heat from the magnet is in this embodiment is dissipated much more effectively than by pure convection to the internal air and the intensive turbulence also conducts it to the walls of the housing 1. What is important here is that, in contrast to prior art constructions, not only the region of the housing which is in contact with the magnet is heated up, but also application of the invention means that the whole surface of the housing is warmed evenly and thus contributes to dissipating heat to the surrounding air. The very hot regions of the housing surface, in particular over the magnets with prior art pumps, are thus avoided so that, for example, the housing ribs 3 to minimize touchable contact surfaces can be dispensed with. This improves heat dissipation from the housing even more, as the convection problems associated with the housing ribs 3 also disappear.

In the detailed embodiment described here, the cover 28 is produced so that it guides part of the air stream 47 to the positional sensor 36 and this part of the air stream is further guided over one or more outlet openings 46. Because the positional sensor 36 is mounted close to the (hot) magnet, the positional sensor is subjected to particularly high temperatures. On passive prior art type cooling, the magnet would be heated to a great extent because of the poor heat dissipation and the positional sensor 36 would assume the approximate surface temperature of the magnet. Using the cooling of the invention with a directed air stream means that the temperature of the positional sensor 36 is kept close to that of the internal air temperature, so that in particular when constructing the connecting rod 19, care should be taken that this sufficiently thermally isolates the sensor elements (CCD receiver 32 and light source 33) from the metallic parts of the magnet. This is of course the case for any electronics (6) built into the housing cover 5. This is also cooled by directing part of the air stream 49 over it.

Positional Sensor

As already discussed, the reference element for the positional indicator in the embodiment described is the shadow-providing body 35 on the extended connecting rod 19 to detect the position, the shadow of which is cast onto the line of CCD cells 32 (charge coupled devices). The active sensor elements described in more detail in the example, which detect the position, are on the side of the thrust member directed towards the metering head. The light source 33 is an LED, the optical receiver is an electronic module with a CCD cell 32, which in this case is mounted on an intermediate part, namely the sensor carrier 31. Mounting the positional sensor 36 on the sensor carrier 31 enables it to be treated in the production process as a stand-alone module and it can, for example, be separately pre-assembled and tested away from final construction location. Furthermore, the lightbox-like arrangement described constitutes a touch-free and thus wear-free sensor.

For the basic function, the location of the sensor is not significant; the location can be determined by structural considerations such as space, order of assembly etc. Further, the parts described here as being fixedly mounted (light source 33, receiver 32) and those which move with the connecting rod (shadow-providing body 35) can exchange functions.

In this example, the CCD module 32 is controlled by an evaluation unit which contains a micro processor and produces the required control signals. Instead of a microprocessor, the evaluation unit can also be produced from a DSP (digital signal processor) or discrete technology.

Any element can be used for the light source 33, as long as it produces a sufficiently narrow light spot. Together with the geometry shown in FIG. 7, this width determines the shadow region SV (see also FIG. 8).

The light source 33 can also be constituted by several elements or a line source and the shadow SV can thus be produced to satisfy particular requirements. An example is the production of high brightness without influencing sharpness in the direction of motion.

The CCD line 32 is a linear arrangement of M optical receivers (hereinafter denoted pixels) which are arranged in a regular array with a pitch R of several μm. As an example, there are 128 pixels 64 μm apart over a total length of about 8 mm, i.e. M=128 and R=64 μm.

The control signals which are produced by the evaluation unit sets the illumination time during which the individual pixels of the CCD line 32 integrate the incident light in an amplifier in the CCD module and stores it for later processing. This integration occurs not only over the illumination period, but also over the light-sensitive surface of each pixel. After illumination, the brightness values for the pixels are successively read by further control signals as analogue values from the CCD module and captured by the evaluation unit.

Illumination and reading of the brightness values occur alternately in the simplest case. Some commercial CCD line constructions also have the possibility of simultaneously carrying out both procedures, wherein they store the integrated illumination measurements and free the integrator immediately for the next measurement. Simultaneous outputting of the results of a measurement during the illumination phase for the subsequent procedure can increase the measurement speed.

The diagram of FIG. 8 shows the integrated brightness values H of the actual shadow in the region of the affected pixels in the concrete example. The shadow region SV extends in this example from pixel #60 to #63.

As a simple evaluation procedure, a decision threshold $H_v$ (shown in FIG. 8 as a dashed line) is set at half the maximum brightness, for example, and the pixel is sought for which the brightness value H in the shadow transition area is the first to dip below the threshold $H_v$; in the example, this would be pixel #62.

In other embodiments, the brightness can be in the opposite direction, with an increasing pixel number from the non illuminated to the illuminated CCD cells; this is dependent on the arrangement of the light source 33, CCD module 32 and shadow-producing body 35 elements and also on the internal organization of the CCD module 32 employed. In this case, the pixel with a brightness which is the first to exceed the threshold is the one which is sought out.

Figure 9:
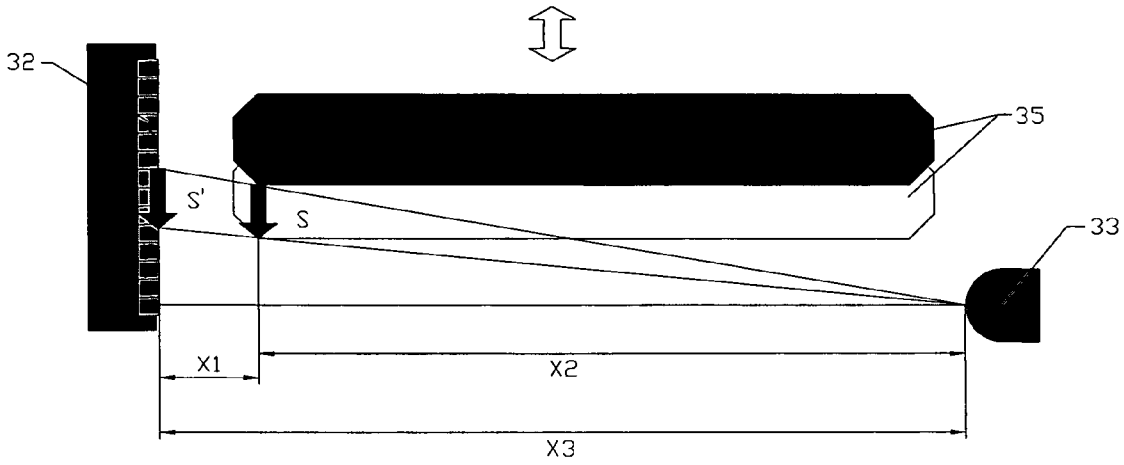
FIG. 9 shows an illustration of positional sensor measurements on the basis of geometrical arrangement.

After the three phases of illumination, reading and processing, a positional value is produced. The total time for the three phases determines the frequency with which positional values are obtained. The measurement resolution is the pixel pitch R of the CCD cells corrected by the geometrical relationship A which is given by the mounting distance between the individual components. For the geometrical relationship A (see FIG. 9):

$$A=s'/s=x_3/x_2$$

where:

s=actual motion of shadow-providing body;

s'=projected motion of shadow-providing body in plane of CCDs;

$x_2$=distance between optical shadow-providing body and light source;

$x_3$=distance between CCD plane and light source.

This procedure determines the position by counting pixels, and is thus a digital procedure. Deviations and shifts in linear parameters such as module sensitivities have practically no effect on the result compared with analogue procedures. If the geometrical relationship A is determined for practical values, then variations in assembly also only have a small influence. In a practical embodiment in which $X_3$=21 mm and $x_2$=20 mm, a nominal value for the ratio A of 1.05 is obtained; i.e. a movement of the shadow-providing body 35 by a particular distance produces a 1.05 times higher shift in the shadow region SV in the plane of the CCD cells 32. Assuming an assembly variation factor for $x_3$, i.e. a possible variation in the distance of the CCD cells 32 from the light source 33, of ±0.3 mm, and assembly on the upper end of the tolerance range with $x_3$=21.3 mm and $x_2$=20 mm, then in this case the geometrical relationship A is 1.065. The geometrical relationship in this example changes by 1.065/1.05=1.014, or by +1.4%. This deviation can readily be eliminated by a single calibration, for example on production. The linearity is almost exclusively determined by the accuracy of the pixel pitch in the chip geometry and deviations are thus vanishingly small.

Although the methods described above for determining the position of the shadow-providing body 35 and thus the position of the diaphragm 13 already gives very exact and linear positional values, interpolation can produce an even more precise positional resolution. In this broadened implementation, evaluation of the pixel brightness H produces a positional resolution, for example between pixels 61 and 62 (see FIG. 10), which is finer than the pixel pitch R, in which the brightness values of the pixels is interpolated in the region of the decision threshold. The aim is to determine the location at which the brightness profile intersects with the decision threshold $H_v$ and to give this intersection a value on a virtual positional scale the x values of which correspond in the middle of the pixels to exactly the pixel number.

Figure 10:
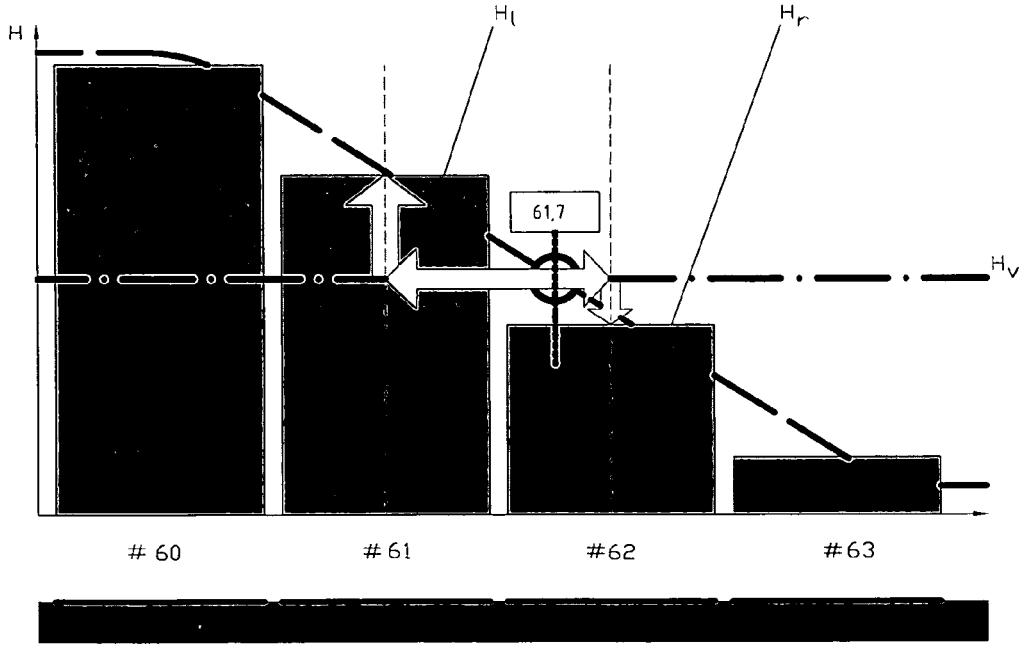
FIG. 10 shows an interpolation of positional resolution.
Figure 11:
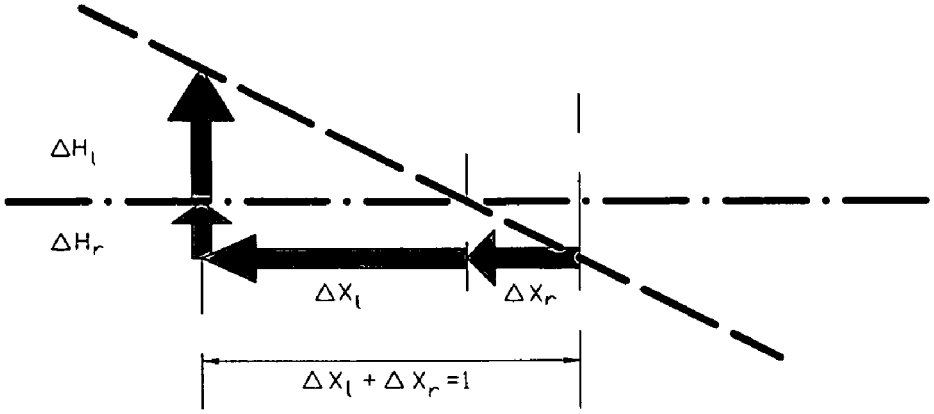
FIG. 11 shows an illustration of calculation basis for interpolation of positional resolution.

To this end, the two pixels to the left and right of the decision threshold $H_v$ are sought and the distance ΔH of the brightness value from this threshold is determined. As shown in FIG. 10 or in FIG. 11:

$$\Delta H_l=H_l-H_v$$

$$\Delta H_r=H_r-H_v$$

The distances Δx, calculated from the central axis of each of the two neighbouring pixels, in this example pixels #61 and #62, in multiples of the pixel width to the intersection point, form the following relationship with the brightness distances ΔH with respect to pixel #61 to the left of the intersecting point (left neighbouring pixel):

$$\Delta x_l/(\Delta x_l+\Delta x_r)=\Delta H_l/(\Delta H_l+\Delta H_r)$$

when $(\Delta x_l+\Delta x_r)=1$ (1 pixel width), then:

$$\Delta x_l=\Delta H_l/(\Delta H_l+\Delta H_r)$$

With respect to pixel #62 to the right of the sought intersecting point (right neighbouring pixel), the following relationship holds:

$$\Delta x_r/(\Delta x_l+\Delta x_r)=\Delta H_r/(\Delta H_l+\Delta H_r)$$

when $(\Delta x_l+\Delta x_r)=1$ (1 pixel width), then:

$$\Delta x_r=\Delta H_r/(\Delta H_l+\Delta H_r)$$

In this example, the intersecting point is at a value of 61.7. If the brightness in the interpolation region follows an ideal straight line, both calculations produce the same result, and so in principle, one of the two calculations can be carried out. However, carrying out both calculations and averaging the results can minimize errors arising through a not exactly straight brightness profile in the transitional region under consideration or through inaccuracies in measurements, which have to be expected.

In other embodiments, the conditions either side of the intersecting point as regards non illuminated and illuminated CCD cells can be exchanged; in this case, the left and right indicators exchange their function as appropriate and the interpolation equations must be altered concomitantly.

Furthermore, other embodiments are possible, wherein brightness values from more than two pixels are used. The position can then be determined by redundant multiple calculations and averaging over several results. In another possible implementation, a linear interpolation other than that discussed here or an interpolation with data from other than directly neighbouring pixels can be used.

Deviations and shifts in linear parameters such as module sensitivities only have an effect on the result within the interpolation region. The slope of the brightness profile in the shadow transitional region resulting from the sharpness of the cast of the shadow-providing body on the CCD plane is of minor significance as the interpolation is broadly unaffected by it; only the linearity of the brightness profile is important for the accuracy of the interpolation.

Independently of the interpolation method described above, further procedures for improving sensor properties can be used, building on the basic principle described. These procedures are described below:

Improved Resistance to Interference by Filtering

The resistance to interference of the sensor can be improved by filtering. Filtering can be applied both to the brightness values for the pixels and to the result of the positional determination itself. In the first case, the procedure operates with brightness values which are averaged over several pixels or several passes, and in the second case several initially determined positional results are collected together into a deduced positional value which is then used for further processing.

Compensation for Variations in Assembly

In a defined phase, for example the rest phase before the actual metering stroke, the positional value for this phase can be determined and stored in a reference memory. During the active motion phase, the positional values relative to the previously determined reference value are processed. The procedure allows variations in assembly in the rest position arising during production and deviations during operation, for example heat expansion, to be automatically compensated for, thus improving accuracy.

Compensation for Scaling Errors

In a further alternative, two or more known positions termed reference positions can be used to scale the positional sensor. This can occur once during the production or test procedure or repeatedly in operation.

In the first case, the reference position is provided by external apparatus, for example pitch positions or external measurement apparatus. From the positional values measured in these reference positions together with knowledge of the actual position of the reference positions, a corrected value for scaling of the positional sensor can be determined and stored for further processing.

In the second case of repeated scaling determination, known positions, for example mechanical buffers or reference signals from further available apparatus are necessary to determine the position. If the diaphragm is at such a known position during operation, the positional value measured from this location can produce a correctional value for the scaling of the positional sensor and it can be stored for further processing.

Compensation for Optical Sensitivity Parameters

In a further embodiment, the brightness values of the fully illuminated pixels are used to provide a representative value for the illumination strength. To this end, for example, a suitable group of pixels can be used to provide an average brightness. The illumination strength can be used to control the illumination so that the available range is optimally exploited; as an example, the brightness or on-time of the light source can be controlled so that the illumination strength of the fully illuminated pixels lies slightly below the burn-out limit for the CCD module. The on-time of the light source is controlled by altering the on/off ratio. For each measurement, the illumination strength is corrected using the ratio obtained previously so that any variations in the illumination parameters, for example on ageing, are smoothed out.

Compensation for Dirt and Pixel Deviations

In a further embodiment, the mechanical construction of the sensor can be structured so that in a defined phase, for example in the rest phase before executing the actual metering stroke, the complete operative pixel range or a large part thereof can be illuminated. A possible embodiment is, for example, to use the shadow-providing edge of the shadow-producing body facing the magnet for the evaluation, whereby the shadow-providing body during the stroke motion sweeps over the sensor and darkens a region of the CCD cells which were illuminated in the previous rest position. In this phase, the brightness of all relevant pixels can be determined and stored individually in a reference memory. Deviations from the measured values for individual pixels from the ideal value can, for example, be compensated for in the form of corrections. During the active motion phase, the brightness of each pixel is first corrected and only then processed further using the reference values previously obtained for each measurement. By dint of this procedure, it is possible to compensate for deviations in the sensitivity of individual pixels brought about by the manufacturing process and also to a certain extent for dirt, and thus to improve accuracy or operational reliability.

Naturally, the CCD receiver cells may also be arranged in two or more rows to increase safety against dropouts by redundancy, for example because of soiling, or to increase the accuracy of measurements by averaging. For particularly large stroke lengths, two or more CCD lines can be combined in order to broaden the measurement region of an individual line beyond the functional limits of a single line.

Matching Magnet Output and Thermal Output

In order to exploit the advantages of a motion controlled magnetic drive metering pump, in particular with slow to stationary motion, the magnet output in particular and active cooling by means of an internal fan inside the housing which were already described above must be considered (see section "cooling of magnet and other components").

The magnet output according to the criteria which normally occur in magnetic drive metering pump is only suitable in a narrow range when operating without modifications under motion controlled operation. In order to make control possible over a wider range, it is vital to be able to react to the natural movements of the mechanical components, even in the worst case where the magnet current changes very rapidly.

However, in prior art constructions, the too high inductivity of the magnetizing coil 2 stands against it, whereby it only reaches its nominal value due to the magnet current $I_M$ after a time of about 20-50 ms. This normal output is selected so that cooperation with the voltage and impedance of the winding 29 (ohmic resistance, inductivity) provides approximately the desired current. In the simple case, this current is given by the supply voltage for the machine, possibly minus a tolerance; with current-controlled embodiments, the dimensions are selected so that the current flow is still guaranteed for the smallest expected supply voltage and for higher voltages it is limited by the control circuit to the preset value.

If the magnet is suitable for controlling the motion, then a much smaller number of windings must be selected, so that the magnet current can be influenced in the shortest time. When using the winding space evenly, the reduction factor of the winding number (N) has a squared effect on the resistance and inductivity, which raises the current rise rate for an unchanged voltage by a ratio of $N^2$. The power requirement for such a magnet power rises in a ratio of N, so that in total the time to reach the operating current is reduced by a factor of N.

In the following example this is explained in more detail. For simplicity, we assume an approximately linear current rise, i.e. purely inductive behaviour of the magnetizing coil 2. A magnetizing coil of the prior art can raise the magnet current by 0.1 A/ms due to its impedance. A necessary operating current of 2 A is thus reached within 20 ms after applying the voltage. If the operating current is reached in half the time (10 ms), the winding number is halved and the cross section of the wire can double, i.e. the wire diameter is increased by a factor of root 2; inductivity and winding resistance drop by a factor of 4, and thus the current rise time rises for an unchanged voltage to 0.4 A/ms. The operating current doubles to 4 A and is reached in half the original time (10 ms).

The controllability can in particular be exploited to slow the natural motion. This extends the magnet current flow $I_M$ almost to continuous operation and thus increases the energy loss per stroke. Depending on which of the described functions is carried out, this can substantially increase the heat to be dissipated. Depending on the extent of this increase, a thermal design using broadened criteria is necessary, with changes in the mechanical construction which make increased heat dissipation possible. The increased and longer lasting operating current $I_M$ of the magnet must be taken into consideration by using the larger modules in the control electronics 44.

Using a positional sensor in connection with controlling the diaphragm motion to improve the hydraulic properties and to broaden the application field of the magnetic drive metering pump must for economic reasons not lead to a need to redesign all of the individual modules of the magnetic drive metering pump. Care should be taken that the known modules can be largely re-used. This is also the case for the on board modules, the construction of which should ensure that parts already used in uncontrolled magnetic drive metering pumps can also be used with controlled magnetic drive metering pumps.

LIST OF REFERENCE NUMERALS

1 housing
2 magnetizing coil
3 housing ribs
4 floor plate
5 housing cover
6 electronics in housing cover
7 adjustment member
8 stroke adjustment pin
9 cover
10 control wires
11 gear (reduction gear)
12 metering head
13 diaphragm
14 inlet valve
15 outlet valve
16 metering chamber
17 magnet shroud
18 longitudinal axis
19 connecting rod
20 thrust member
21 O-ring
22 inner face of thrust member
23 compression spring (recuperating spring)
24 inner face of magnet shroud
25 magnet plate
26 pressure head side bush
27 thrust member side bush
28 cover
29 coil winding
30 diaphragm core
31 sensor carrier
32 receiver, CCD module
33 light source
34 opening
35 shadow-providing body as reference element
36 positional sensor
37 differentiator
38 nominal value setting
39 nominal-actual comparison
40 PID regulation
41 positional correction
42 amplifier
43 fan
44 control electronics
45 electronic power modules
46 air flow outlet opening
47 air flow of fan
48 partial air flow for positional sensor
49 partial air flow for electronics in housing cover
50 links
51 coil carrier

LIST OF SYMBOLS

SV shadow profile
h lit region
d dark region
#58 . . . #65 cells (pixels) of CCD
H brightness of pixels
$H_v$ brightness of comparison threshold (VS)
$H_l$ brightness of pixels to the left of intersecting point with VS (left hand side neighbouring pixel)
$\Delta H_l$ brightness difference between left hand side neighbouring pixel and brightness value of comparison threshold
$H_r$ brightness of pixels to the right of intersecting point with VS (right hand side neighbouring pixel)
$\Delta H_r$ brightness difference between right hand side neighbouring pixel and brightness value of comparison threshold
$\Delta x_l$ positional separation of middle line of left hand side neighbouring pixel to intersecting point with VS
$\Delta x_r$ positional separation of middle line of right hand side neighbouring pixel to intersecting point with VS
$x_1$ distance between shadow-providing body and CCD plane
$x_2$ distance between shadow-providing body and light source
$x_3$ distance between CCD plane and light source
$p_1$ operating pressure $p_1$
$p_2$ operating pressure $p_2$
$p_3$ operating pressure $p_3$
$p_4$ operating pressure $p_4$
$x_{T1}$ dead region for operating pressure $p_1$
$x_{T2}$ dead region for operating pressure $p_2$
$x_{T3}$ dead region for operating pressure $p_3$
$x_{T4}$ dead region for operating pressure $p_4$
s actual motion of shadow-providing body
s' projected motion of shadow-providing body
D metering performance
HL mechanical stroke length
SG controller output
KSG corrected controller output
k1 factor for positional dependent positional current correction
k2 factor for performance amplifier
k3 factor for deviation of speed signal
$x_s$ nominal value for position of thrust member
$x_I$ actual value for position of thrust member
$x_{SI}$ controlled deviation for position of thrust member
$v_s$ nominal value for speed of thrust member
$v_I$ actual value for speed of thrust member
$V_{SI}$ controlled deviation for speed of thrust member
$P_{OS}$ positional signal in diagrams
EPos end buffer for positional signal in diagrams
$I_M$ magnet current
$I_{Mo}$ zero position of magnet current signal in diagrams

What is claimed is:

1. A magnetic drive metering pump comprising a movable thrust member, fixed to a connecting rod, axially movable in a longitudinal axis in a magnet shroud anchored in a pump housing so that the thrust member with the connecting rod, on electrically activating a magnetizing coil (29) to magnetize a magnet in the magnet shroud, is drawn into the magnet shroud against the force of a recuperating spring into a bore in the magnet shroud, reducing an airgap between the thrust member and an inner face of the magnet shroud, and after deactivating the magnet the thrust member is returned to a starting position by the recuperating spring so that the thrust member and spring actuated thereby carries out an oscillating motion on continued activation and deactivation of the magnetizing coil, said connecting rod being interconnected to a flexible pumping diaphragm such that the diaphragm oscillates with the connecting rod, said diaphragm cooperating alternately with an outlet and an inlet valve to produce a pump stroke and a priming stroke in a metering head arranged in the longitudinal axis, wherein a reference element (35) is associated with a module constituted by the thrust member (20) and connecting rod (19), a position of which reference element is detected by a positional sensor (36), wherein the positional sensor provides a signal ($X_I$) determined and monitored during the whole pump stroke and priming stroke, wherein the signal ($X_I$) has a fixed relationship to the position of the reference element, and wherein a control circuit utilizes the signal ($X_I$) to adjust the motion of the module formed by the thrust member (20) and the connecting rod (19), within a predetermined nominal profile (38), wherein the reference element (35) influences a path of light from a light source (33) to the positional sensor cooperating therewith (36), wherein the positional sensor is fixed on the magnet shroud and operates in a light sensitive manner, wherein the reference element (35) is a shadow-producing body or a shadow producing contour and the positional sensor (36) arranged on the magnet shroud consists of an optical receiver (32) in the form of a series of light sensitive charged coupled devices (CCD).

2. The magnetic drive metering pump according to claim 1 wherein the positional sensor (36) detects the position of the reference element (35) in accordance with a touch-free principle.

3. The magnetic drive metering pump according to claim 1 wherein the reference element (35) associated with the connecting rod (19) and the positional sensor (36) is outside the metering head.

4. The magnetic drive metering pump according to claim 1 wherein the positional sensor (36) is arranged on a sensor carrier which is fixed to the magnet shroud.

5. The magnetic drive metering pump according to claim 1 wherein the light source (33), the shadow-producing body or shadow-producing contour (35) and the optical receiver (32) constitute a measuring arrangement and measured values are continuously or intermittently fed to to an electronic control system within the control circuit.

6. The magnetic drive metering pump according to claim 1 wherein the optical receiver (32) of the positional sensor (36) consists of linearly arranged light sensitive charged coupled devices.

7. The magnetic drive metering pump according to claim 1 wherein the light source (33) is a light emitting diode (LED) which is arranged opposite the optical receiver (32) of the positional sensor (36) so that its light beam which is directed at the optical receiver is not interrupted by the connecting rod (19).

8. The magnetic drive metering pump according to claim 1 wherein a start value for the positional sensor (36) is produced by interpolating brightness of a plurality of pixels in a shadow transition region.

9. The magnetic drive metering pump according to claim 1 wherein when processing the signals from a the positional sensor (36), filtering is employed.

10. The magnetic drive metering pump according to claim 1 wherein zero position errors of the positional sensor (36) are eliminated by means of a reference memory.

11. The magnetic drive metering pump according to claim 1 wherein scaling errors of the positional sensor (36) are eliminated by using one or more reference positions.

12. The magnetic drive metering pump according to claim 1 wherein variations in illumination of the positional sensor (36) are compensated for by controlling or regulating the light source (33) using pixel brightness values obtained.

13. The magnetic drive metering pump according to claim 1 wherein variations in brightness between individual pixels from the optical receiver (32) are compensated for by using a reference memory for a sensitivity of each pixel.

* * * * *

UNITED STATES PATENT AND TRADEMARK OFFICE

CERTIFICATE OF CORRECTION

PATENT NO. : 8,267,667 B2
APPLICATION NO. : 11/507167
DATED : September 18, 2012
INVENTOR(S) : Freudenberger et al.

It is certified that error appears in the above-identified patent and that said Letters Patent is hereby corrected as shown below:

In the claims -
At Column 27, In Claim 3, line 34, “outside” should read --inside--.
At Column 28, In Claim 9, line 22, “a the” should read --the--.

Signed and Sealed this
Thirtieth Day of April, 2013

Teresa Stanek Rea
*Acting Director of the United States Patent and Trademark Office*